US010464789B2

(12) United States Patent
Kataoka et al.

(10) Patent No.: US 10,464,789 B2
(45) Date of Patent: Nov. 5, 2019

(54) UPPER TURNING BODY FOR CRANE

(71) Applicants: KOBE STEEL, LTD., Kobe-shi (JP); KOBELCO CONSTRUCTION MACHINERY CO., LTD., Hiroshima-shi (JP)

(72) Inventors: Yasuto Kataoka, Kobe (JP); Takunori Yamaguchi, Kobe (JP); Hiromitsu Hamaguchi, Hyogo (JP); Yasuhiro Nakashima, Kobe (JP); Yoji Hanawa, Kobe (JP); Hiroki Nakayama, Hyogo (JP)

(73) Assignees: KOBE STEEL, LTD., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 330 days.

(21) Appl. No.: 15/120,975

(22) PCT Filed: Feb. 27, 2014

(86) PCT No.: PCT/JP2014/001055
§ 371 (c)(1),
(2) Date: Aug. 23, 2016

(87) PCT Pub. No.: WO2015/128898
PCT Pub. Date: Sep. 3, 2015

(65) Prior Publication Data

US 2016/0362282 A1 Dec. 15, 2016

(51) Int. Cl.
*B66C 23/62* (2006.01)
*B66C 13/54* (2006.01)
(Continued)

(52) U.S. Cl.
CPC ..... *B66C 23/62* (2013.01); *B66C 13/54* (2013.01); *B66C 23/64* (2013.01); *B66C 23/36* (2013.01)

(58) Field of Classification Search
CPC ..... B66C 23/00; B66C 23/26; B66C 23/36; B66C 23/365; B66C 23/62; B66C 23/64; B66C 23/70
See application file for complete search history.

(56) References Cited

U.S. PATENT DOCUMENTS 2,739,716 A * 3/1956 Poulter ..... E02F 9/02 212/247
3,757,881 A * 9/1973 Short ..... B62D 55/084 180/9.1
(Continued)

FOREIGN PATENT DOCUMENTS

CN 1938217 A 3/2007
JP 48-26667 U 3/1973
(Continued)

OTHER PUBLICATIONS

Machine Translation of JP 2012076924 (Year: 2012).*
(Continued)

*Primary Examiner* — William E Dondero
*Assistant Examiner* — Juan J Campos, Jr.
(74) *Attorney, Agent, or Firm* — Oblon, McClelland, Maier & Neustadt, L.L.P.

(57) ABSTRACT

An upper turning body mounted on a lower body for a crane includes a turning frame mounted on the lower body to turn freely and a boom provided to the turning frame to be raised and lowered freely. The turning frame includes a pair of attachment brackets to which a base end section of the boom is attached such that the boom is free to be raised and lowered, and a main frame to which the pair of attachment brackets are provided with an interval in the left-right
(Continued)

direction of the upper turning body. The dimension of the main frame in the front-rear direction of the upper turning body orthogonal to the left-right direction is smaller than the dimension of the main frame in the left-right direction.

7 Claims, 20 Drawing Sheets

(51) Int. Cl.
*B66C 23/64* (2006.01)
*B66C 23/36* (2006.01)

(56) References Cited

U.S. PATENT DOCUMENTS 4,231,699 A * 11/1980 Thompson ..... B62D 55/10 180/9.1
4,253,579 A * 3/1981 Williams ..... B66C 23/70 52/650.2
4,394,911 A 7/1983 Wittman et al.
5,100,278 A 3/1992 Westlake
5,823,279 A * 10/1998 Petzold ..... B62D 55/084 180/9.1
6,857,489 B2 * 2/2005 Lakes ..... B62D 55/00 180/305
7,007,764 B2 * 3/2006 Smith ..... B66C 23/62 180/9.1
7,293,375 B2 * 11/2007 Fukushima ..... E02F 9/02 180/311
8,910,732 B1 * 12/2014 Risen ..... B66C 23/62 180/9.48
9,108,827 B2 * 8/2015 Willim ..... B66C 23/70
2003/0150138 A1 * 8/2003 Akahane ..... B62D 21/16 37/347
2007/0175849 A1 8/2007 Yokoyama et al.
2009/0261053 A1 * 10/2009 Bohnacker ..... B66C 23/60 212/300
2010/0213155 A1 * 8/2010 Hanahara ..... B66C 23/36 212/294
2010/0258364 A1 * 10/2010 Bolz ..... B60K 15/063 180/9.1
2011/0290751 A1 12/2011 Yamaguchi et al.

FOREIGN PATENT DOCUMENTS

JP 51-91557 A 8/1976
JP 2000-291064 A 10/2000
JP 2005-314106 A 11/2005
JP 3122148 U 6/2006
JP 2007-91404 A 4/2007
JP 2007-119180 A 5/2007
JP 3939819 B2 7/2007
JP 2007-191286 A 8/2007
JP 2010-195542 A 9/2010
JP 2011-46503 A 3/2011
JP 2011-219273 A 11/2011
JP 2011-225343 A 11/2011
JP 2012-76924 A 4/2012

OTHER PUBLICATIONS

International Search Report dated May 13, 2014 in PCT/JP2014/001055 filed Feb. 27, 2014.
Office Action dated Apr. 18, 2017 in Chinese Patent Application No. 201480076489.9 (with English summary).
Japanese Office Action dated Mar. 6, 2018 in Patent Application No. 2017-077764 (with English translation), 8 pages.
Japanese Office Action dated Feb. 7, 2017 in Patent Application No. 2013-167810 (with English translation).

* cited by examiner

UPPER TURNING BODY FOR CRANE

TECHNICAL FIELD

The present invention relates to an upper turning body for a crane.

BACKGROUND ART

Conventionally, a crane including an upper turning body mounted on a lower body to turn freely has been known. The upper turning body of the crane includes a turning frame attached on the lower body to turn freely and a boom attached to the turning frame to be raised and lowered freely. Patent Literature 1 to 4 below disclose an example of such a crane.

Due to, for example, the influence of inertia force caused by turning of the upper turning body or of wind, force in the left-right direction is applied to the boom in some cases. In such cases, the boom deflects in the left-right direction. Particularly, in recent years, the amount of deflection of the boom in the left-right direction tends to increase, along with an increase in size of the crane or an increase in length of the boom. Under such circumstances, deflection of the boom in the left-right direction cannot be suppressed sufficiently with a conventional structure of the upper turning body, and work under limitations in hoisting load is increasing as a result.

In order to solve this problem, it is conceivable, for example, to increase the dimension (width) of the boom in the left-right direction and enhance the stiffness of the boom in the left-right direction. However, in this case, there occurs a problem that transportation of the turning frame of the upper turning body is difficult upon transportation of the crane. The reason is as follows.

As described in each patent literature below, a crane is in some cases transported after being disassembled into various equipment and members forming the crane. Therefore, a crane is configured to enable easy disassembly into units suitable for transportation.

An upper turning body of a conventional crane schematically includes a structure as shown in FIG. 20. The upper turning body includes a turning frame 720 and a boom 740. The front section of the turning frame 720 is provided with a pair of attachment brackets 721. The boom 740 includes a base end section attached to the pair of attachment brackets 721.

Upon transportation of the crane, the upper turning body is detached from a lower body. The detached upper turning body is disassembled into the turning frame 720, the boom 740, and various equipment, members, and the like mounted on the turning frame 720. Transportation of the crane is generally performed by a transportation vehicle such as a trailer. Upon the transportation, the turning frame 720 of the upper turning body is, in a state where the left-right direction thereof matches the left-right direction (car width direction) of the transportation vehicle and where the front-rear direction thereof matches the front-rear direction (car length direction) of the transportation vehicle, loaded on the transportation vehicle. Regarding vehicles passing through public roads, a limit value of the dimension in the left-right direction including a loaded object, i.e., transportation limit width, is specified by laws and regulations. Therefore, it is desired that the dimension in the left-right direction be kept less than or equal to the transportation limit width also for components of the crane, in a state of being loaded on the transportation vehicle.

However, when a dimension $W_B$ of the boom 740 in the left-right direction is increased in order to suppress deflection of the boom 740 in the left-right direction, it is necessary to increase the interval between the pair of attachment brackets 721 to which the base end section of the boom 740 is attached. In this case, a dimension (width) $W_F$ of the turning frame 720 in the left-right direction also has to be increased. As a result, when the turning frame 720 is to be loaded on a transportation vehicle and transported as described above, the dimension $W_F$ of the turning frame 720 in the left-right direction exceeds the transportation limit width in some cases. In such cases, there is a risk that the turning frame 720 cannot be transported.

CITATION LIST

Patent Literature

Patent Literature 1: Japanese Unexamined Patent Publication No. 2007-191286

Patent Literature 2: Japanese Unexamined Patent Publication No. 2007-119180

Patent Literature 3: Japanese Patent No. 3939819

Patent Literature 4: Japanese Unexamined Patent Publication No. 2010-195542

SUMMARY OF INVENTION

An object of the present invention is to enable transportation of a turning frame of an upper turning body to be carried out upon transportation of a crane, while suppressing deflection of a boom in the left-right direction.

An upper turning body for a crane according to one aspect of the present invention is an upper turning body mounted on a lower body for a crane, including a turning frame mounted on the lower body to turn freely and a boom provided to the turning frame to be raised and lowered freely, wherein the turning frame includes a pair of attachment brackets to which a base end section of the boom is attached such that the boom is free to be raised and lowered, and a main frame to which the pair of attachment brackets are provided with an interval in a left-right direction of the upper turning body, and a dimension of the main frame in a front-rear direction of the upper turning body orthogonal to the left-right direction is smaller than a dimension of the main frame in the left-right direction.

An upper turning body for a crane according to another aspect of the present invention is an upper turning body mounted on a lower body for a crane, including a turning frame mounted on the lower body to turn freely and a boom provided to the turning frame to be raised and lowered freely, wherein the turning frame includes a pair of attachment brackets to which a base end section of the boom is attached such that the boom is free to be raised and lowered, and a frame body to which the pair of attachment brackets are provided with an interval in a left-right direction of the upper turning body, and the frame body is formed of a plurality of divided frames arranged side by side in the left-right direction of the upper turning body, adjacent divided frames of the plurality of divided frames being separably joined to each other.

DESCRIPTION OF EMBODIMENTS

Embodiments of the present invention will be described below with reference to the drawings.

First Embodiment

Referring to FIG. 1 to FIG. 4, the configuration of an upper turning body for a crane according to a first embodiment of the present invention will be described.

Figure 1:
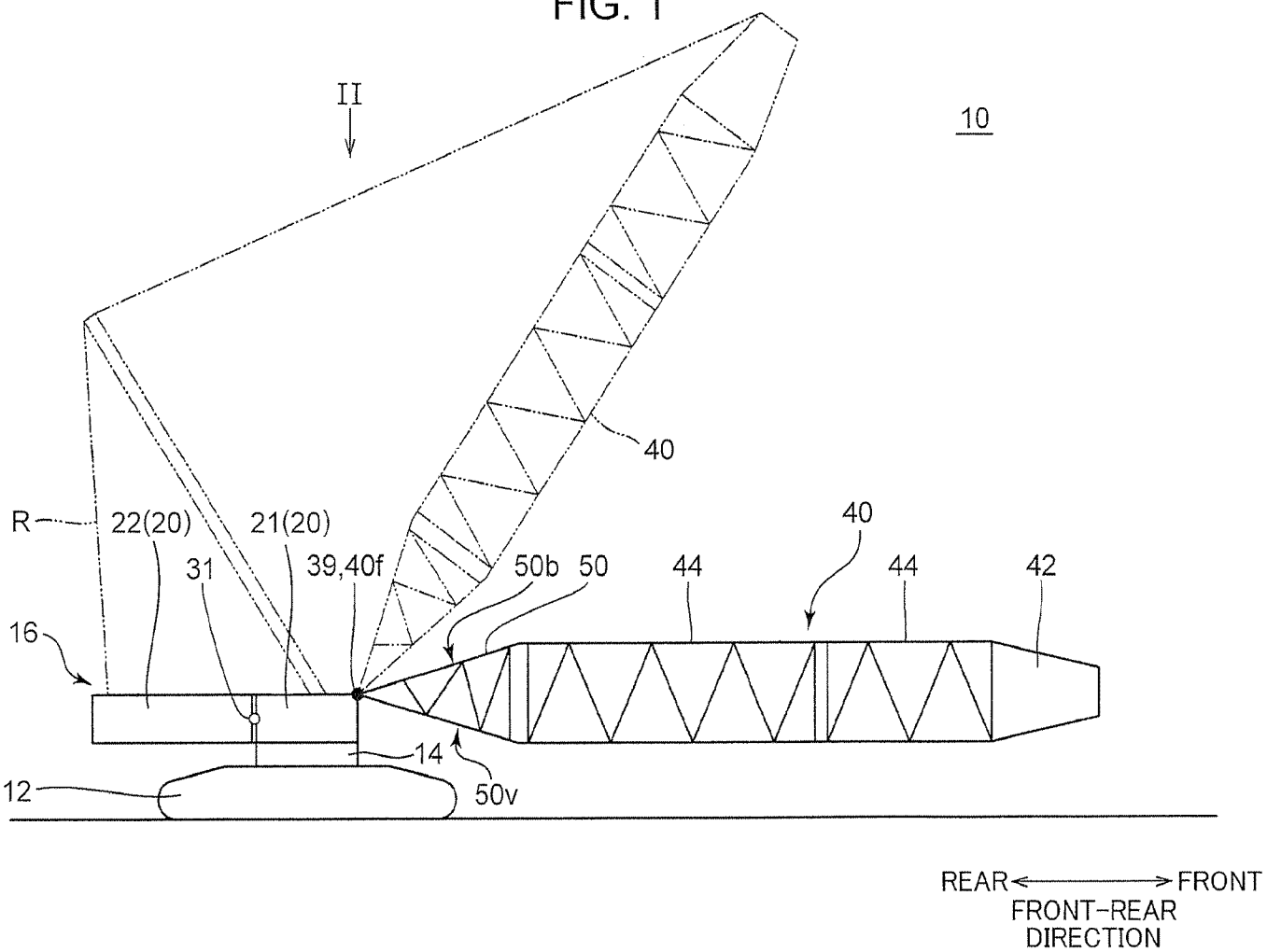
FIG. 1 is a schematic view, seen from the right side, of a crane to which an upper turning body according to a first embodiment of the present invention is applied.

An upper turning body 16 according to the first embodiment is used in a crane 10 as shown in FIG. 1. The crane 10 allows for disassembly into a plurality of component parts. The crane 10 is in an assembled state shown in FIG. 1 when performing hoisting work. The crane 10, upon transportation, is disassembled into the plurality of component parts and in a disassembled transportation state for loading on a transportation vehicle (such as a truck or trailer). When the transportation vehicle passes through a public road, limits in dimensions specified by laws and regulations need to complied with. Therefore, upon transportation of the crane, the crane needs to be disassembled into component parts of sizes and units of which the dimension is kept less than the limit value, in a state of being loaded on the transportation vehicle. The limit value of dimension upon passing through of a public road is the limit value of length of the transportation vehicle in the front-rear direction and the limit value of width of the transportation vehicle in the left-right direction. The limit value of width in the left-right direction is smaller compared to the limit value of length in the front-rear direction. The crane 10 can be in the assembled state or the disassembled transportation state as described above. Hereinafter, it is assumed that the crane 10 is in the assembled state, unless otherwise stated.

The crane 10 is a mobile crane. The crane 10 includes a lower traveling body 12, a turn support 14 attached to the lower traveling body 12, and the upper turning body 16 mounted to turn freely on the lower traveling body 12 with the turn support 14 therebetween.

The lower traveling body 12 is a crawler-type self-propelled carrier. The lower traveling body 12 is an example of a lower body of the present invention. A wheeled carrier may be used as the lower traveling body.

The turn support 14 supports the upper turning body 16 such that the upper turning body 16 turns freely with respect to the lower body 12. For the turn support 14, a swing bearing is used, for example.

The upper turning body 16 is attached on the turn support 14. The upper turning body 16 includes a turning frame 20 as a base of the upper turning body 16 and a boom 40 attached to the turning frame 20 to be raised and lowered freely. The upper turning body 16 also includes a counterweight, a cab (operating cabin), an engine, a winch, and the like, although omitted in the drawing.

The turning frame 20 is mounted on the lower traveling body 12 with the turn support 14 therebetween, so as to turn freely with respect to the lower traveling body 12. The counterweight, the cab, the engine, the winch, and the like, omitted in the drawing, are attached to the turning frame 20. The "front-rear direction" mentioned in the description below is a direction that, when the crane 10 in the assembled state, matches the axial direction of the boom 40 in a state where the boom 40 has been lowered (see the boom 40 shown by solid lines in FIG. 1) such that the axial direction of the boom 40 is parallel to the horizontal plane. The "left-right direction" mentioned in the description below is a direction orthogonal to the front-rear direction and parallel to the horizontal plane.

Figure 2:
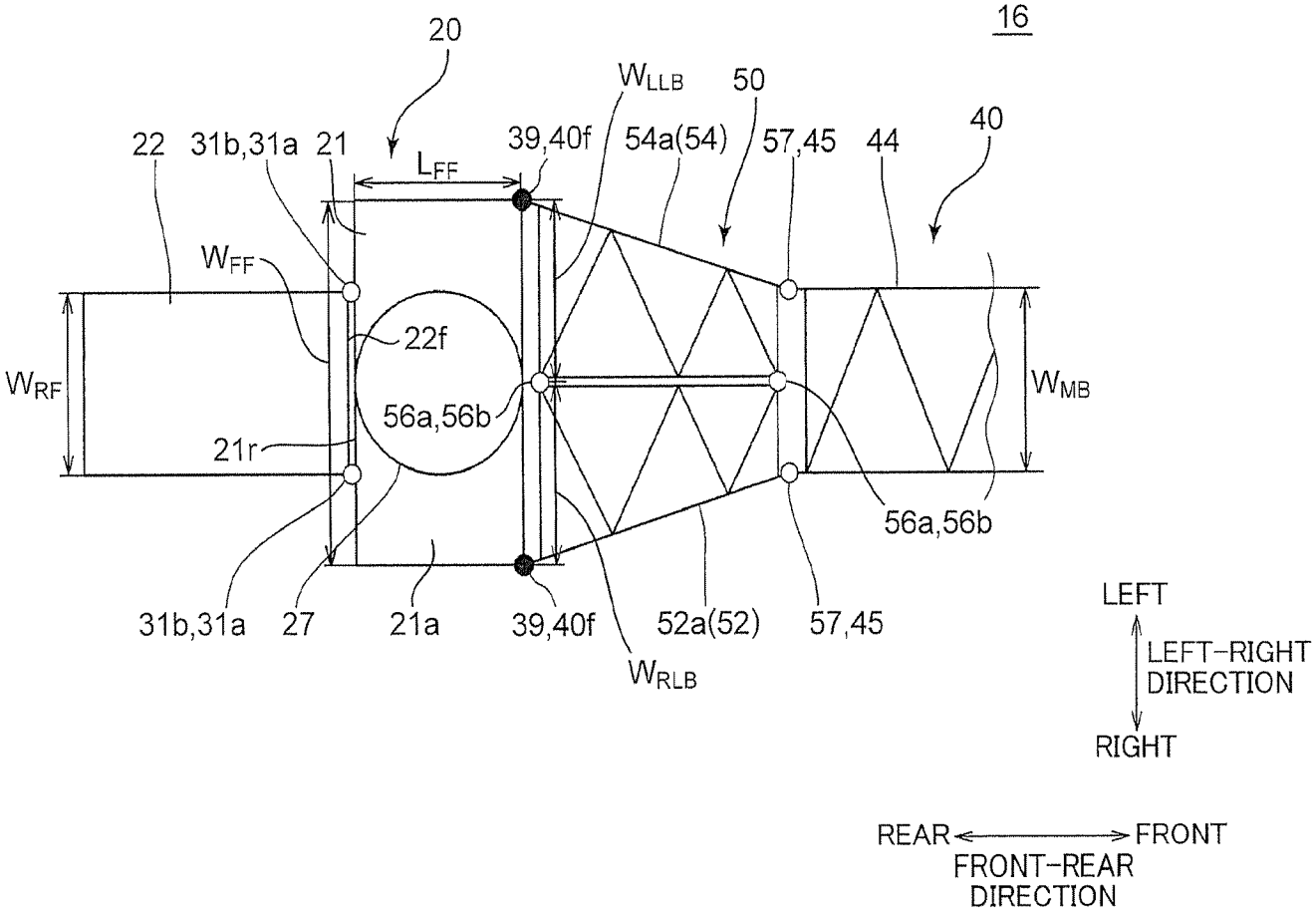
FIG. 2 is a view, seen from above (from the arrow II direction), of the upper turning body shown in FIG. 1.

The turning frame 20 is configured to allow for disassembly into a plurality of members in the front-rear direction. As shown in FIG. 2, the turning frame 20 includes a front-side frame 21, a rear-side frame 22, a turn support attachment section 27, and a pair of attachment brackets 39.

The front-side frame 21 forms a front section of the turning frame 20. The front-side frame 21 is included in the concept of a main frame of the present invention. The front-side frame 21 is provided with the turn support attachment section 27 and the pair of attachment brackets 39. The rear-side frame 22 forms a rear section of the turning frame 20. The rear-side frame 22 is included in the concept of a subframe of the present invention. The rear-side frame 22 is arranged in the rear of the front-side frame 21 and separably joined to the front-side frame 21. Thus, the turning frame 20 allows for disassembly in the front-rear direction into the front-side frame 21 provided with the turn support attachment section 27 and the attachment bracket 39 and the rear-side frame 22.

A dimension $W_{FF}$ of the front-side frame 21 in the left-right direction is larger than a dimension $L_{FF}$ of the front-side frame 21 in the front-rear direction and larger than a dimension $W_{RF}$ of the rear-side frame 22 in the left-right direction. The front-side frame 21 and the rear-side frame 22 are joined to each other in a state where center positions of the two frames 21 and 22 in the left-right direction are located on the same straight line. In that state, the two frames 21 and 22 are arranged in a T-shape when seen from above.

Upon transportation of the crane 10, the front-side frame 21 and the rear-side frame 22 are separated from each other and each loaded on a transportation vehicle. At this time, the front-side frame 21 is loaded on the transportation vehicle, in a state where the left-right direction of the front-side frame 21 when the crane 10 is in the assembled state matches the front-rear direction (car length direction) of the transportation vehicle and where the front-rear direction of the front-side frame 21 when the crane 10 is in the assembled state matches the left-right direction (car width direction) of the transportation vehicle. The dimension $W_{FF}$ of the front-side frame 21 in the left-right direction when the crane 10 is in the assembled state is larger than a transportation limit width upon the transportation vehicle passing through a public road. The dimension $L_{FF}$ of the front-side frame 21 in the front-rear direction when the crane 10 is in the assembled state, i.e., the dimension of the front-side frame 21 in the left-right direction when the crane 10 is in the disassembled transportation state, is less than or equal to the transportation limit width. The dimension $L_{FF}$ of the front-side frame 21 in the front-rear direction is preferably equivalent or approximately equivalent to the transportation limit width.

Upon transportation, the rear-side frame 22 is loaded on the transportation vehicle, in a state where the left-right direction of the rear-side frame 22 when the crane 10 is in the assembled state matches the left-right direction of the transportation vehicle and where the front-rear direction of the rear-side frame 22 when the crane 10 is in the assembled state matches the front-rear direction of the transportation vehicle. The dimension $W_{RF}$ of the rear-side frame 22 in the left-right direction when the crane 10 is in the assembled state is less than or equal to the transportation limit width. The dimension $W_{RF}$ of the rear-side frame 22 in the left-right direction is also preferably equivalent or approximately equivalent to the transportation limit width.

The front-side frame 21 includes a front-side frame body 21*a* and a pair of front-side joint brackets 31*a*.

The front-side frame body 21*a* is a portion forming an approximately rectangular frame structure of the front-side frame 21. The front-side frame body 21*a* takes up most of the front-side frame 21. The pair of front-side joint brackets 31*a* are provided in an area of the front-side frame body 21*a* that overlaps with a front surface 22*f* of a rear-side frame body 22*a*, described later, when seen from the front-rear direction, and are arranged separately at both left and right end sections of the area. The front-side joint bracket 31*a* is arranged on the front side relative to a rear surface 21*r* of the front-side frame body 21*a*. Specifically, the front-side joint bracket 31*a* is arranged to extend to the front side from the rear surface 21*r* of the front-side frame body 21*a*, as if penetrating inside the front-side frame body 21*a*. The rear surface 21*r* of the front-side frame body 21*a* is a side surface facing the left or right of the transportation vehicle, when the crane 10 is in the disassembled transportation state. Therefore, by the front-side joint bracket 31*a* being arranged as described above, the front-side joint bracket 31*a* does not protrude to the left or right of the front-side frame body 21*a*, in a state where the front-side frame 21 is loaded on the transportation vehicle.

The turn support attachment section 27 is a portion to which the turn support 14 (see FIG. 1) is attached. The turn support attachment section 27 is provided in the middle of the bottom surface (lower surface) of the front-side frame body 21*a*. The turn support attachment section 27 includes a plurality of bolt holes (not shown) or the like provided to be aligned in a circle along the turn support 14.

The rear-side frame 22 includes the rear-side frame body 22*a* and a pair of rear-side joint brackets 31*b*.

The rear-side frame body 22*a* is a portion forming an approximately rectangular frame structure of the rear-side frame 22. The rear-side frame body 22*a* takes up most of the rear-side frame 22. The rear-side frame body 22*a* is mounted with a counterweight, a winch, and the like, omitted in the drawing.

The pair of rear-side joint brackets 31*b* are portions to be joined to the pair of front-side joint brackets 31*a* of the front-side frame 21. By the rear-side joint bracket 31*b* being joined to the front-side joint bracket 31*a*, the rear-side frame 22 and the front-side frame 21 are integrally assembled (joined). The pair of rear-side joint brackets 31*b* are provided to the front end of the rear-side frame body 22*a*. Specifically, the pair of rear-side joint brackets 31*b* are attached to the front surface 22*f* of the rear-side frame body 22*a* and arranged with an interval from each other in the left-right direction. The respective rear-side joint brackets 31*b* are each provided to parts slightly on the inside from both left and right ends of the front surface 22*f* of the rear-side frame body 22*a*. Therefore, the rear-side joint brackets 31*b* do not protrude to both left and right sides from the rear-side frame body 22*a*, in a state where the rear-side frame 22 is loaded on the transportation vehicle.

The structure of the front-side joint bracket 31*a* and the rear-side joint bracket 31*b* and a joint structure of the two brackets 31*a* and 31*b* will be described in detail below.

Figure 3:
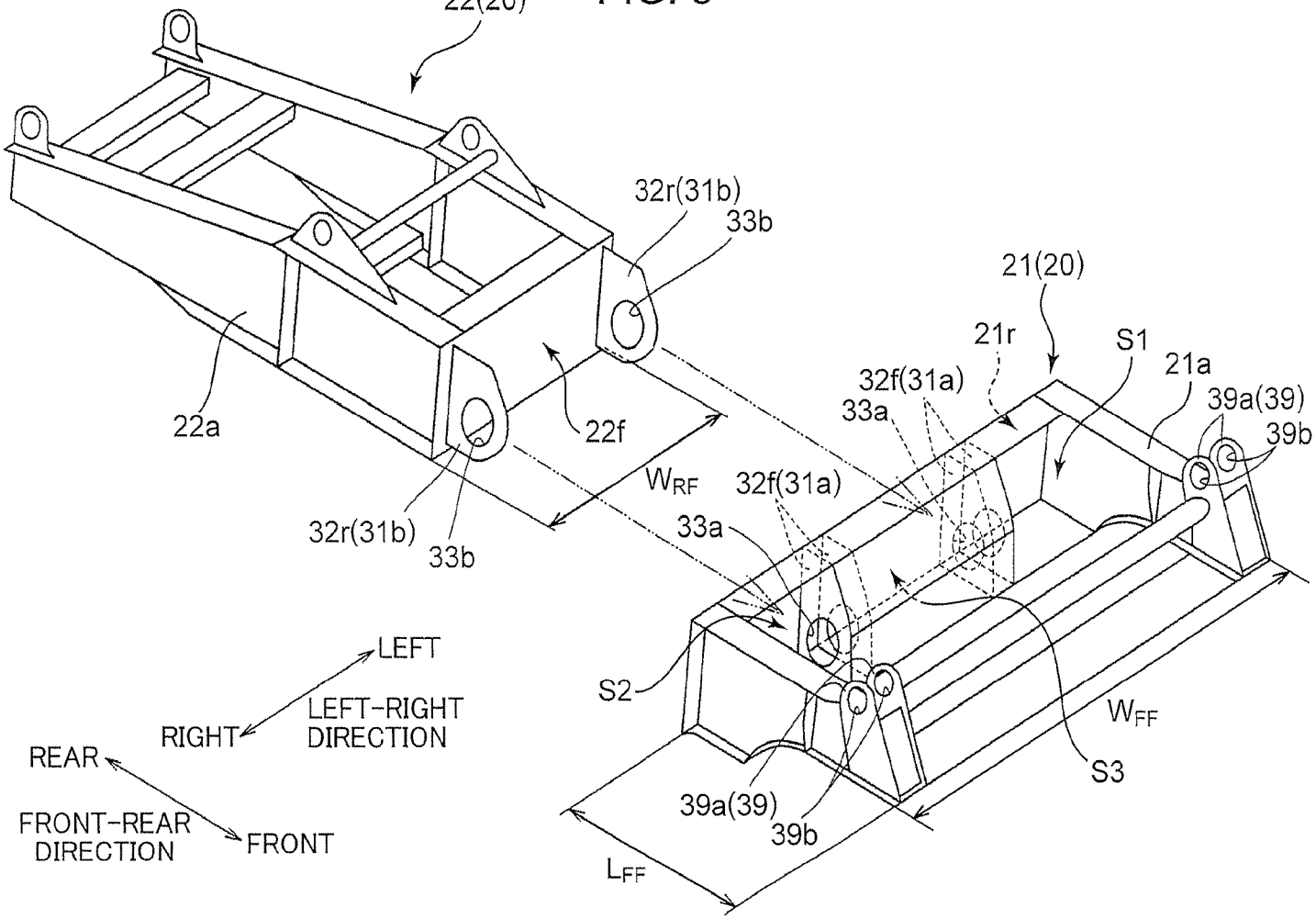
FIG. 3 is an exploded perspective view of a turning frame of the upper turning body shown in FIG. 2.

The respective front-side joint brackets 31*a* each include two front-side joint plates 32*f* fixed to the front-side frame body 21*a*. Each front-side joint plate 32*f* is formed with a hole 33*a* to which a pin P (see FIG. 4A) is inserted and fitted. In FIG. 3, only a part of a plurality of the holes 33*a* is denoted by a reference sign to avoid complexity. Each rear-side joint bracket 31*b* is formed of one rear-side joint plate 32*r* fixed to the rear-side frame body 22*a*. Each rear-side joint plate 32*r* is formed with a hole 33*b* to which the pin P is inserted and fitted. Of the pair of front-side joint brackets 31*a*, the front-side joint bracket 31*a* on the right side is joined to the rear-side joint bracket 31*b* on the right side. Of the pair of front-side joint brackets 31*a*, the front-side joint bracket 31*a* on the left side is joined to the rear-side joint bracket 31*b* on the left side.

Each front-side joint bracket 31*a* and the corresponding rear-side joint bracket 31*b* are joined in a manner below. Joining of the brackets 31*a* and 31*b* on the left side and joining of the brackets 31*a* and 31*b* on the right side are similar. Therefore, a representative description will be given for joining of one front-side joint bracket 31*a* and one corresponding rear-side joint bracket 31*b*.

The rear-side joint plate 32*r* of the rear-side joint bracket 31*b* is inserted between the two front-side joint plates 32*f* forming the front-side joint bracket 31*a*, and in that state, the pin P is inserted to the hole 33*a* of the front-side joint plate 32*f* and the hole 33*b* of the rear-side joint plate 32*r*. Accordingly, the front-side joint bracket 31*a* and the rear-side joint bracket 31*b* are joined to each other.

Figure 4A:
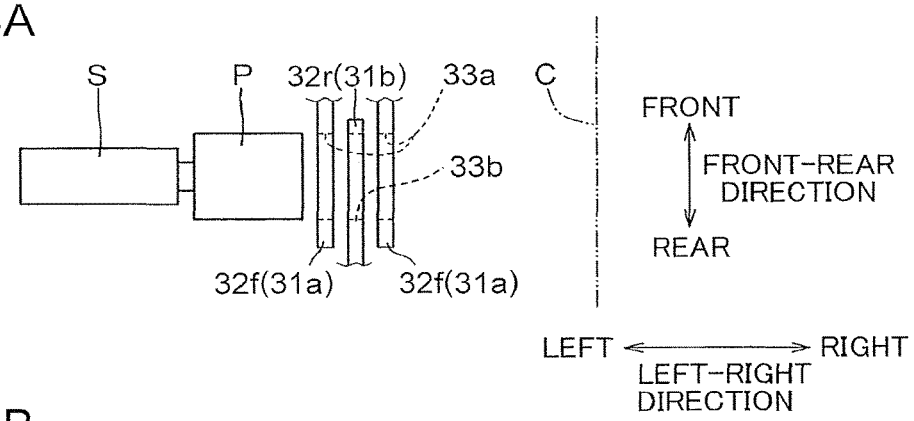
FIG. 4A is a schematic view, seen from above, of a state before joining, with a pin, of a front-side joint bracket and a rear-side joint bracket of the turning frame shown in FIG. 3.
Figure 4B:
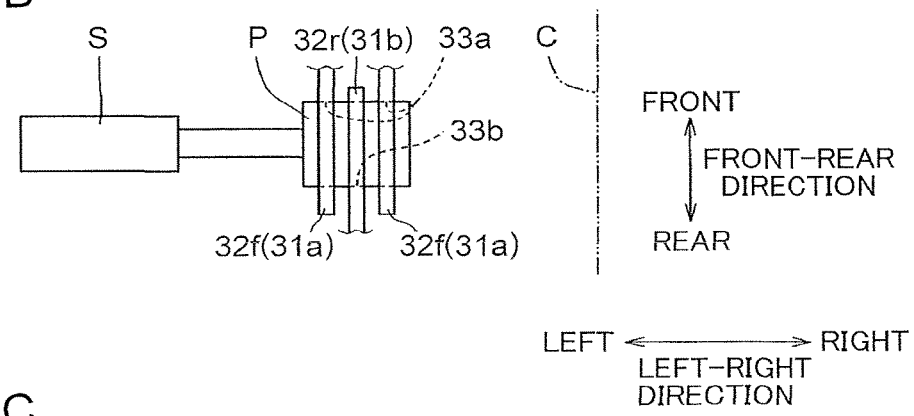
FIG. 4B is a schematic view, seen from above, of a state where the front-side joint bracket and the rear-side joint bracket of the turning frame shown in FIG. 3 are joined with a pin.
Figure 4C:
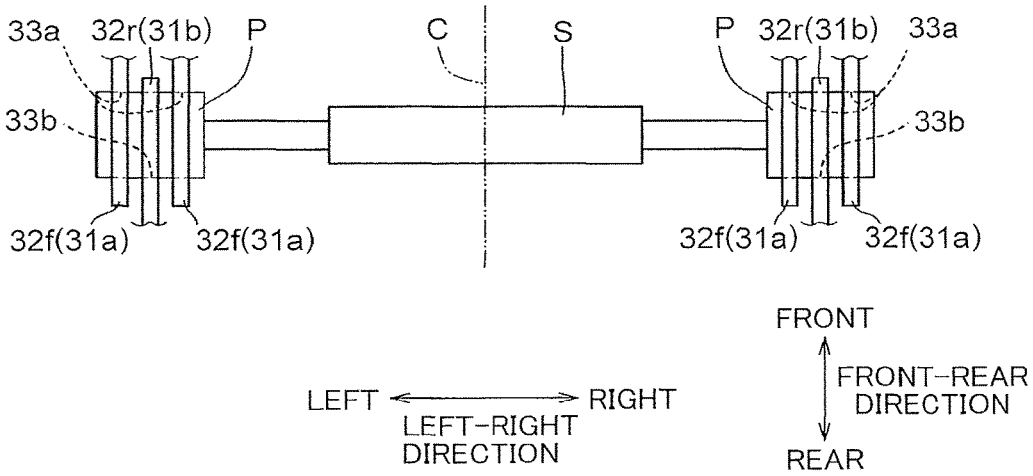
FIG. 4C is a schematic view, seen from above, of another example of a joint structure of the front-side joint bracket and the rear-side joint bracket of the turning frame.

Although illustration is omitted in FIG. 2 and FIG. 3, a telescopic cylinder S (see FIG. 4A to FIG. 4C) for insertion and removal of the pin P with respect to the holes 33*a* and 33*b* of the joint plates 32*f* and 32*r* is attach to the front-side frame body 21*a*. The telescopic cylinder S may be attached to the rear-side frame body 22*a*. By extending, the telescopic cylinder S inserts the pin P to the holes 33*a* and 33*b* of the joint plates 32*f* and 32*r* (see FIG. 4A). By retracting, the telescopic cylinder S removes the pin P from the holes 33*a* and 33*b* of the joint plates 32*f* and 32*r* (see FIG. 4B). A center line C in FIG. 4A to FIG. 4C is a center line located at the center of the turning frame 20 in the left-right direction and extending in the front-rear direction. The number of the front-side joint plates 32*f* and the rear-side joint plates 32*r* may be changed.

As shown in FIG. 4A and FIG. 4B, one telescopic cylinder S is provided with respect to the front-side joint bracket 31*a* and the rear-side joint bracket 31*b* in one part. That is, since the front-side joint bracket 31*a* and the rear-side joint bracket 31*b* are provided in two parts in the turning frame 20, two telescopic cylinders S are provided in a corresponding manner. Specifically, the telescopic cylinders S are each arranged in a position on the left side with respect to the front-side joint bracket 31*a* on the left side in the front-side frame body 21*a* and the right side with respect to the left side surface of the front-side frame body 21*a* (position of S1 in FIG. 3) and a position on the right side with respect to the front-side joint bracket 31*a* on the right side in the front-side frame body 21*a* and the left side with respect to the right side surface of the front-side frame body 21*a* (position of S2 in FIG. 3). The telescopic cylinder S is located to the side of the holes 33*a* and 33*b* and arranged coaxially with the holes 33*a* and 33*b*.

As shown in FIG. 4C, one common telescopic cylinder S may be provided with respect to the front-side joint brackets 31*a* and the rear-side joint brackets 31*b* in two parts. In this case, the telescopic cylinder S is arranged in a position between the front-side joint brackets 31*a* in two left and right parts in the front-side frame body 21*a* (position of S3 in FIG. 3) and arranged in a state of extending to the left and right across the center line C in the left-right direction of the turning frame 20. The telescopic cylinder S in this case is configured to be capable of extending and retracting to both left and right sides. At each of both ends of the telescopic cylinder S, the pin P is attached. By the telescopic cylinder S extending to both left and right sides, the pins P on both sides are each inserted to the holes 33*a* and 33*b* of the corresponding joint plates 32*f* and 32*r* (in a state of FIG. 4C). By the telescopic cylinder S retracting inward from both left and right sides, the pins P on both sides are each removed from the holes 33*a* and 33*b* of the corresponding joint plates 32*f* and 32*r*. With this configuration, the pins P can be detached and attached with respect to the brackets on both left and right sides with one telescopic cylinder S.

To the rear-side frame 22, a force to lower the boom 40 (see FIG. 1) is transferred via a wire rope R and the like. Therefore, a rotating force acts on the rear-side frame 22 to raise and rotate the rear-side frame 22 upward with respect to the front-side frame 21 about the pin P as the axis. At this time, the upper end section of the front surface 22*f* of the rear-side frame body 22*a* is held in place by the upper end section of the rear surface 21*r* of the front-side frame body 21*a*, thereby inhibiting turning of the rear-side frame 22 about the pin P as the axis.

The pair of attachment brackets 39 (see FIG. 2 and FIG. 3) are for attachment of a base end section 40*f* of the boom 40 such that the boom 40 is free to be raised and lowered. The pair of attachment brackets 39 are provided to the front end section of the front-side frame 21 (the front-side frame body 21*a*). The pair of attachment brackets 39 are formed integrally with the front-side frame 21 (the front-side frame body 21*a*). The pair of attachment brackets 39 are arranged at the front end section of the front-side frame 21 with a left-right interval. Specifically, the attachment bracket 39 is provided to each of the left end section and right end section of the front end section of the front-side frame 21 (the front-side frame body 21*a*). The respective left and right attachment brackets 39 are each formed of two attachment plates 39*a*. Each attachment plate 39*a* is arranged in a posture in line with the front-rear direction and the up-down direction of the upper turning body 16 (the turning frame 20). Each attachment plate 39*a* is formed with a hole 39*b* to which a pin, omitted in the drawing, is inserted and fitted. The hole 39*b* penetrates the attachment plate 39*a* in the left-right direction (thickness direction of the attachment plate 39*a*). The two attachment plates 39*a* of each attachment bracket 39 holds therebetween a plate section, omitted in the drawing, forming the base end section 40*f* of the boom 40. By the pin being inserted and fitted in this state to the hole 39*b* of the attachment plate 39*a* and a hole, omitted in the drawing, formed in the plate section of the base end section 40*f* (boom foot), the boom 40 is attached to the front-side frame 21 to be raised and lowered freely.

As shown in FIG. 1, the boom 40 is a member for suspending a load or the like, omitted in the drawing. The boom 40 extends linearly in a predetermined direction. The boom 40 is a lattice boom including a latticed structure. The boom 40 allows for disassembly in the axial direction thereof (extending direction of the boom 40) into a plurality of members. Specifically, the boom 40 includes an upper boom 42, an intermediate boom 44, and a lower boom 50 arranged in order from the tip end side to the base end side. The upper boom 42 and the intermediate boom 44 are separably joined to each other, and the intermediate boom 44 and the lower boom 50 are separably joined to each other. It is possible to omit the intermediate boom 44.

The lower boom 50 is a member forming a region of the boom 40, the region being a region which has a specific length from the base end section 40*f* to the tip end section side of the boom 40. The lower boom 50 is attached to the pair of attachment brackets 39 provided to the front-side frame 21. The lower boom 50 is tapered to gradually increase in distance between a back surface 50*b* and a ventral surface 50*v*, toward the tip end side from the base end section 40*f*, when seen in the left-right direction (see FIG. 1). The back surface 50*b* is a surface facing the upper side of the lower boom 50 in a state where the boom 40 is lowered as in FIG. 1. The ventral surface 50*v* is a surface facing the lower side of the lower boom 50 in the same state. The lower boom 50 is tapered to gradually increase in dimension in the left-right direction, toward the base end section 40*f* side from the tip end side (see FIG. 2). The tapered shape of the lower boom 50 may not be necessarily formed uniformly from the base end section to the tip end section of the lower boom 50 and may be formed up to some point. The dimension of the base end section of the lower boom 50 (the base end section 40*f* of the boom 40) in the left-right direction is equivalent or approximately equivalent to the dimension $W_{FF}$ of the front-side frame 21 in the left-right direction. The dimension of the tip end section of the lower boom 50 in the left-right direction is equivalent to a dimension $W_{MB}$ of the intermediate boom 44 in the left-right direction. The dimension $W_{MB}$ of the intermediate boom 44 in the left-right direction is a dimension less than or equal to the transportation limit width and preferably a dimension equivalent to the transportation limit width. In the intermediate boom 44 or the like as well, a tapered portion continuous with the tapered shape of the lower boom 50 may be formed.

The lower boom 50 allows for disassembly into a plurality of (two in this embodiment) members in the left-right direction (left-right direction when the crane is in the assembled state). Specifically, as shown in FIG. 2, the lower boom 50 includes a right-side divided boom 52 forming the right-side section of the lower boom 50 and a left-side divided boom 54 forming the left-side section of the lower boom 50. The right-side divided boom 52 and the left-side divided boom 54 are separably joined to each other. The right-side divided boom 52 and the left-side divided boom 54 are included in the concept of a divided boom of the present invention.

The right-side divided boom 52 includes a right-side divided boom body 52*a* and a right-side boom joint bracket 56*a*. The left-side divided boom 54 includes a left-side divided boom body 54*a* and a left-side boom joint bracket 56*b*.

The right-side divided boom body 52*a* is formed in a lattice structure. The right-side divided boom body 52*a* takes up most of the right-side divided boom 52. The right-side divided boom body 52*a* is externally in a trapezoidal shape when seen from above in a state where the boom 40 is lowered. The right side surface of the right-side divided boom body 52*a* forms the right side surface of the lower boom 50. The right side surface of the right-side divided boom body 52*a* is inclined away from the left side surface of the right-side divided boom body 52*a* toward the base end section side of the lower boom 50. The right-side boom joint bracket 56*a* is provided to each of the upper section and lower section of the front end section (end section on the intermediate boom 44 side) of the left side surface and the rear end section (end section on the front-side frame 21 side) of the left side surface of the right-side divided boom 52.

The left-side divided boom body 54*a* is structured to be vertically symmetrical to the right-side divided boom body 52*a*. The left-side divided boom body 54*a* takes up most of the left-side divided boom 54. The left side surface of the left-side divided boom body 54*a* forms the left side surface of the lower boom 50. The left side surface of the left-side divided boom body 54*a* is inclined away from the right side surface of the left-side divided boom body 52*a* toward the base end section side of the lower boom 50. The left-side boom joint bracket 56*b* is provided to each of the upper section and lower section of the front end section (end section on the intermediate boom 44 side) of the right side surface and the rear end (end section on the front-side frame 44 side) of the right side surface of the left-side divided boom 52.

By the right-side boom joint bracket 56*a* arranged at the front end section of the right-side divided boom body 52*a* and the left-side boom joint bracket 56*b* arranged at the front end section of the left-side divided boom body 54*a* being joined to each other with a pin, and the right-side boom joint bracket 56*a* arranged at the rear end section of the right-side divided boom body 52*a* and the left-side boom joint bracket 56*b* arranged at the rear end section of the left-side divided boom body 54*a* being joined to each other with a pin, the right-side divided boom 52 and the left-side divided boom 54 are joined to each other. The specific configuration of each right-side boom joint bracket 56*a* and the left-side boom joint bracket 56*b* joined thereto is similar to the configuration described above of the front-side joint bracket 31*a* and the rear-side joint bracket 31*b* joined thereto.

The tip end section of the lower boom 50 is provided with a coupling bracket 57 separably joined to a coupling bracket 45 at the base end section of the intermediate boom 44. The coupling bracket 57 is provided to both left and right ends of the tip end section of the lower boom 50, i.e., the left end of the tip end section of the left-side divided boom body 54*a* and the right end of the tip end section of the right-side divided boom body 52*a*. The configuration of each coupling bracket 57 of the lower boom 50 and the coupling bracket 45 of the intermediate boom 44 joined thereto is similar to the configuration described above of the front-side joint bracket 31*a* and the rear-side joint bracket 31*b* joined thereto.

Upon transportation of the crane 10, the lower boom 50 is separated from the front-side frame 21 and the intermediate boom 44, and then disassembled into the right-side divided boom 52 and the left-side divided boom 54. That is, the lower boom 50 is disassembled, with the center in the left-right direction thereof as a boundary, into the right-side divided boom 52 and the left-side divided boom 54. The base end section of the right-side divided boom 52 is a part where the dimension in the left-right direction is largest in the right-side divided boom 52. The base end section of the left-side divided boom 54 is a part where the dimension in the left-right direction is largest in the left-side divided boom 54. A dimension $W_{RLB}$ of the base end section of the right-side divided boom 52 in the left-right direction and a dimension $W_{LLB}$ of the base end section of the left-side divided boom 54 in the left-right direction are dimensions less than or equal to the transportation limit width and preferably dimensions equivalent to the transportation limit width. Upon transportation of the crane 10, the right-side divided boom 52 and the left-side divided boom 54 are separated from each other, and then, in a state where the left-right directions thereof match the left-right direction of the transportation vehicle, loaded on the transportation vehicle.

In the first embodiment, the dimension $W_{FF}$ of the front-side frame 21 in the left-right direction is large, and the interval between the pair of attachment brackets 39 provided to the front-side frame 21 is large. Therefore, the dimension in the left-right direction of the lower boom 50 attached to the pair of attachment brackets 39 can be increased. As a result, the stiffness in the left-right direction (lateral stiffness) near the base end section of the boom 40 can be enhanced. Therefore, deflection in the left-right direction (lateral deflection) of the boom 40 can be suppressed.

In the first embodiment, the dimension $L_{FF}$ of the front-side frame 21 in the front-rear direction is smaller than the dimension $W_{FF}$ of the front-side frame 21 in the left-right direction and less than or equal to the transportation limit width. Therefore, upon transportation of the crane 10, the transportation width of the front-side frame 21 can be reduced to less than or equal to the transportation limit width of a public road, by loading the front-side frame 21 on the transportation vehicle in a state where the front-rear direction of the front-side frame 21 matches the left-right direction of the transportation vehicle. Thus, in the first embodiment, transportation of the front-side frame 21 of the upper turning body 16 can be carried out, while suppressing deflection of the boom 40 in the left-right direction.

In the first embodiment, the rear-side frame 22 is connected to the rear of the front-side frame 21 when the crane 10 is in the assembled state. Therefore, the dimension of the upper turning body 16 in the front-rear direction can be increased, and the stability of the upper turning body can be improved. By the rear-side frame 22 being provided, a large installation space for various equipment and members mounted to the upper turning body 16 can be ensured. Therefore, a layout of the various equipment and members mounted to the upper turning body 16 can be performed easily. Since the rear-side frame 22 is separable from the front-side frame 21, separating the rear-side frame 22 from the front-side frame 21 upon transportation of the crane 10 enables the front-side frame 21 to be, in a state where the front-rear direction thereof matches the left-right direction of the transportation vehicle, loaded on the transportation vehicle as described above for transportation in a state where the transportation width of the front-side frame 21 is kept to less than or equal to the transportation limit width. Since the dimension $W_{RF}$ of the rear-side frame 22 in the left-right direction is a dimension less than or equal to the transportation limit width, loading the rear-side frame 22, in a state where the left-right direction thereof matches the left-right direction of the transportation vehicle, on the transportation vehicle also enables the transportation width of the rear-side frame 22 to be reduced to less than or equal to the transportation limit width.

In the first embodiment, the dimension of the lower boom 50 in the left-right direction decreases toward the tip end side, while a large dimension of the base end section of the lower boom 50 in the left-right direction is ensured as described above to suppress deflection of the boom 40 in the left-right direction. Therefore, the weight of the lower boom 50 can be reduced, compared to a case where the lower boom 50 is formed such that the large dimension of the base end section in the left-right direction remains constant up to the tip end section. Thus, in the first embodiment, an increase in weight of the boom 40 can be suppressed, while suppressing deflection of the boom 40 in the left-right direction.

In the first embodiment, the lower boom 50 is configured of the right-side divided boom 52 and the left-side divided boom 54 arranged side by side in the left-right direction, and the right-side divided boom 52 and the left-side divided boom 54 are separably joined to each other. Therefore, even when the dimension of the base end section of the lower boom 50 (the base end section 40*f* of the boom 40) in the left-right direction exceeds the transportation limit width, the transportation width of the lower boom 50 can be reduced upon transportation of the crane 10 by dividing the lower boom 50 into the right-side divided boom 52 and the left-side divided boom 54. As a result, the transportation width of the lower boom 50 can be prevented from exceeding the transportation limit width.

Since the lower boom 50 decreases in dimension in the left-right direction toward the tip end side in the first embodiment, the weight of the lower boom 50 can be reduced, compared to a case where the dimension of the lower boom 50 in the left-right direction is constant, up to the tip end section, at the large dimension of the base end section in the left-right direction. As a result, an increase in weight of the boom 40 can be suppressed.

Modified Example 1 of First Embodiment

Figure 5A:
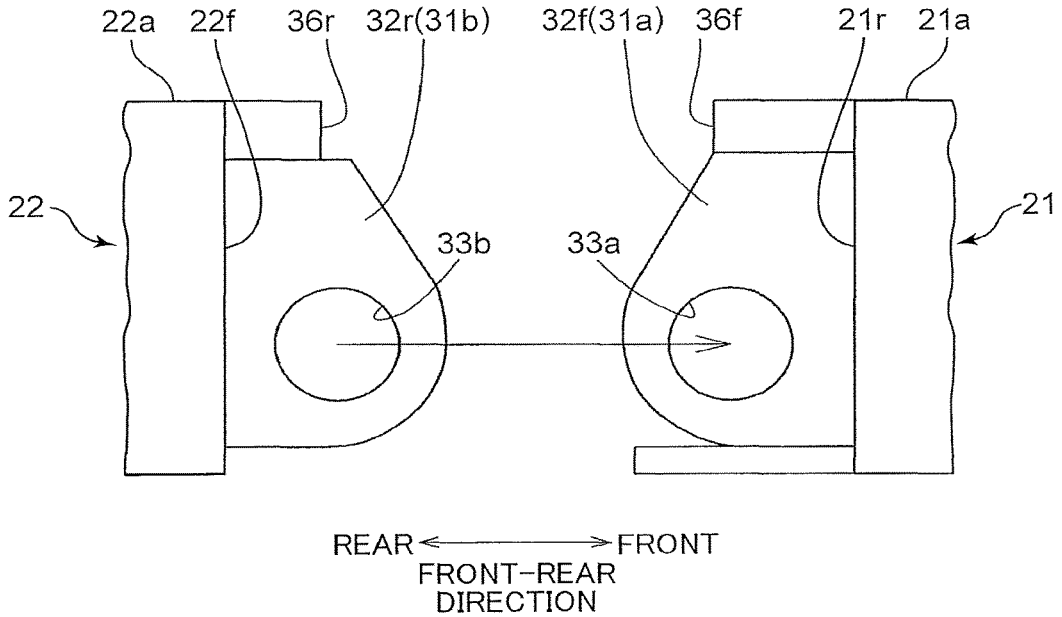
FIG. 5A is a view partially showing a state before joining of a front-side frame and a rear-side frame according to modified example 1 of the first embodiment, the state being seen from the side.
Figure 5B:
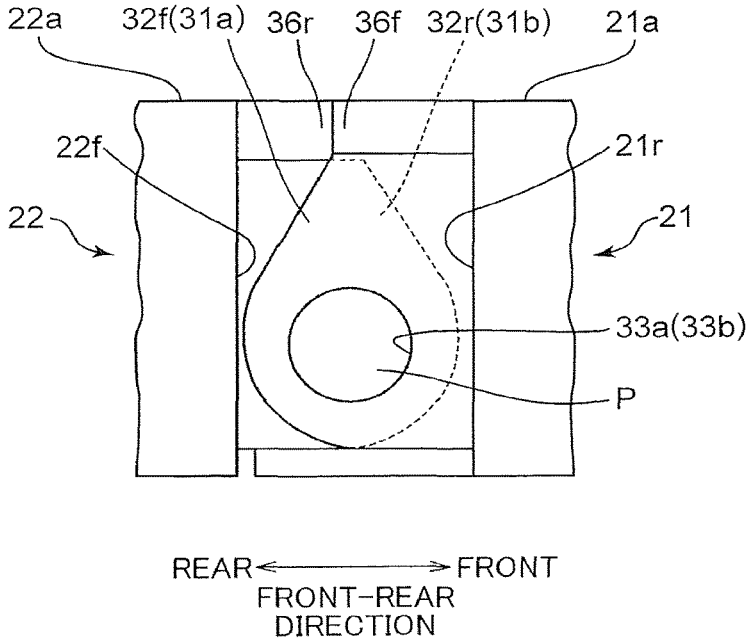
FIG. 5B is a view showing a state, seen from the side, of a joined portion of the front-side frame and the rear-side frame according to modified example 1 of the first embodiment.

FIG. 5A and FIG. 5B show a joint structure of the front-side frame 21 and the rear-side frame 22 of the upper turning body according to modified example 1 of the first embodiment. Referring to FIG. 5A and FIG. 5B, the difference of the upper turning body according to modified example 1 from the upper turning body according to the first embodiment will be described.

In the upper turning body according to modified example 1, the two front-side joint plates 32*f* of each front-side joint bracket 31*a* each protrude rearward from the rear surface 21*r* of the front-side frame body 21*a*. The front-side frame 21 includes a front-side stopper 36*f*, and the rear-side frame 22 includes a rear-side stopper 36*r*.

The front-side stopper 36*f* and the rear-side stopper 36*r* are members for inhibiting relative turning of the rear-side frame 22 with respect to the front-side frame 21 about the pin P (see FIG. 5B) as the axis. As shown in FIG. 5A, the front-side stopper 36*f* is attached to the rear surface 21*r* of the front-side frame body 21*a*. The rear-side stopper 36*r* is attached to the front surface 22*f* of the rear-side frame body 22*a*. When the crane 10 is in the assembled state, i.e., when the front-side frame 21 and the rear-side frame 22 are joined to each other, the front-side stopper 36*f* and the rear-side stopper 36*r* are arranged in an adjacent state with a gap existing therebetween or in a state of contact with each other. The front-side stopper 36*f* is fixed to the upper end of the front-side joint plate 32*f* The rear-side stopper 36*r* is fixed to the upper end of the rear-side joint plate 32*r*. The respective stoppers 36*f* and 36*r* are formed in a cuboid shape, for example.

A force to lower the boom 40 (see FIG. 1) is transferred to the rear-side frame 22 via the wire rope R and the like. As a result, when a rotating force acts on the rear-side frame 22 to raise and rotate the rear-side frame 22 upward with respect to the front-side frame 21 about the pin P as the axis, the rear-side stopper 36*r* is held in place by the front-side stopper 36*f* as shown in FIG. 5B, thereby inhibiting turning of the rear-side frame 22 about pin P as the axis.

The front-side stopper 36*f* may be fixed to the lower end of the front-side joint plate 32*f*, and the rear-side stopper 36*r* may be fixed to the lower end of the rear-side joint plate 32*r*.

Modified Example 2 of First Embodiment

Figure 6:
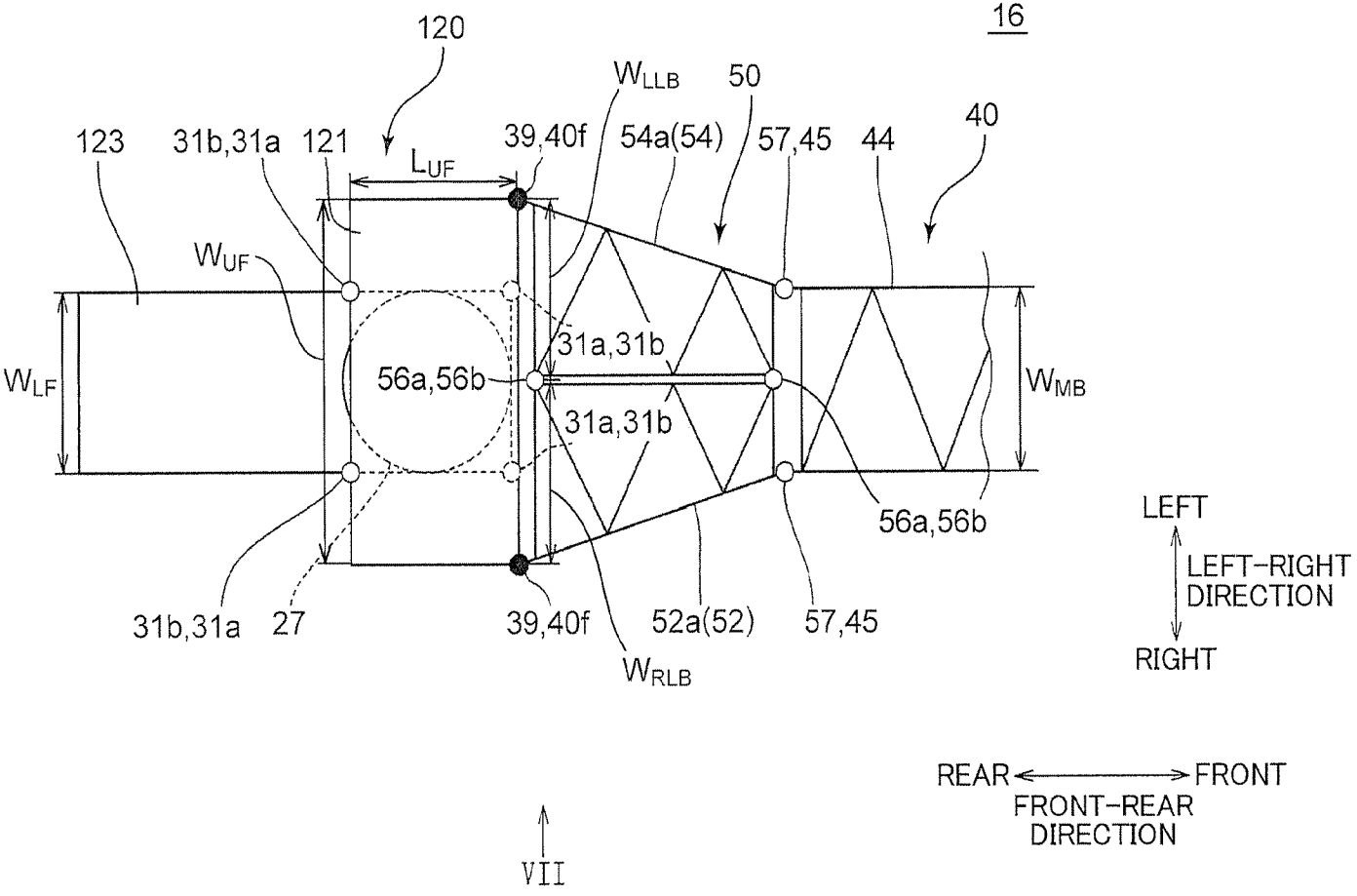
FIG. 6 is a view corresponding to FIG. 2 for modified example 2 of the first embodiment.
Figure 7:
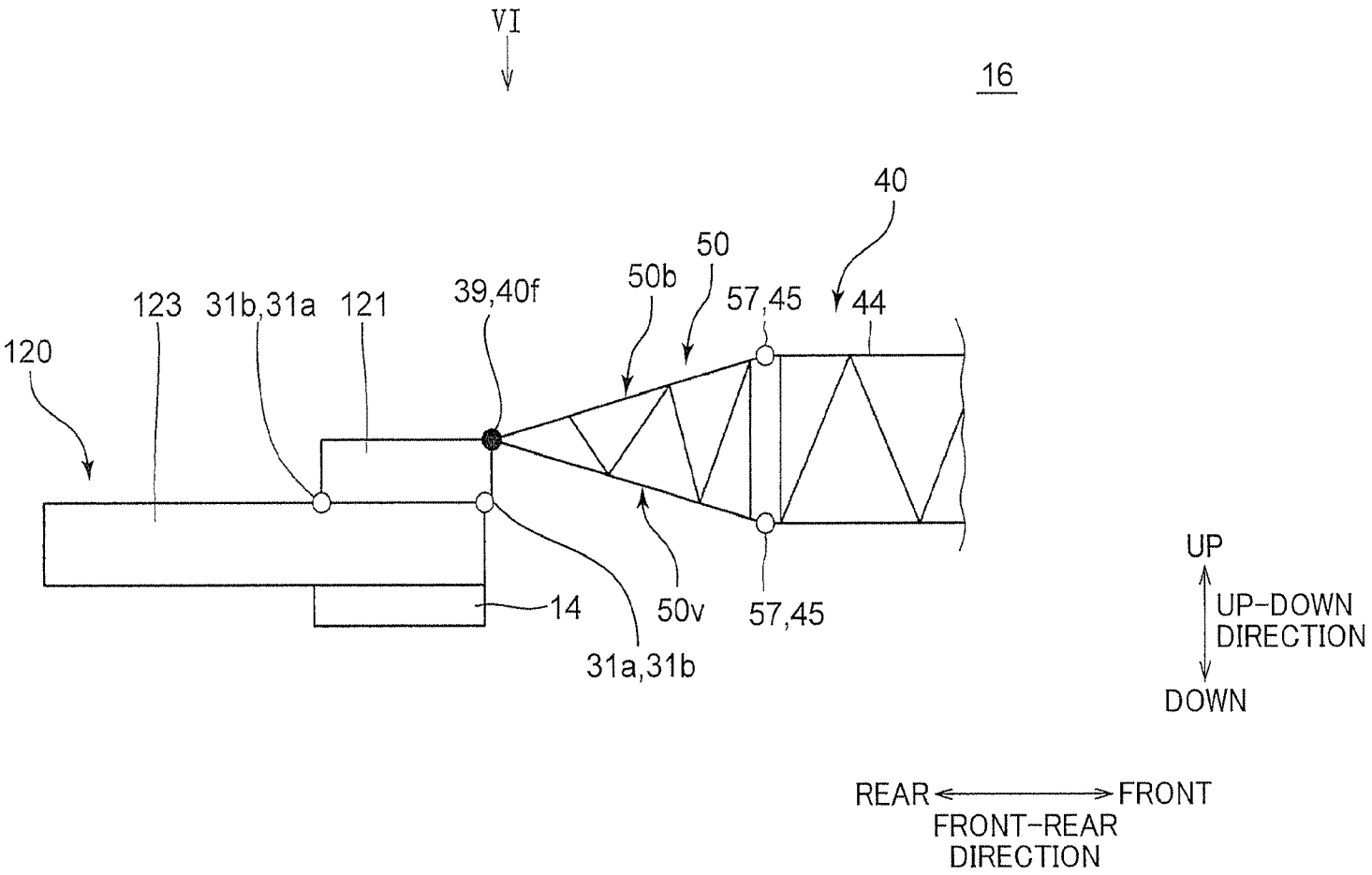
FIG. 7 is a view on arrow VII of FIG. 6.

Referring to FIG. 6 and FIG. 7, the difference of a turning frame 120 of the upper turning body 16 according to modified example 2 of the first embodiment from the turning frame 20 of the upper turning body according to the first embodiment above will be described. FIG. 7 is a view on arrow VII of FIG. 6. FIG. 6 is a view on arrow VI of FIG. 7.

Unlike the turning frame 20 according to the first embodiment, the turning frame 120 according to modified example 2 of the first embodiment allows for disassembly into a plurality of members in the up-down direction of the crane in the assembled state.

Specifically, the turning frame 120 includes an upper-side frame 121 and a lower-side frame 123 arranged below the upper-side frame 121 and separably joined to the upper-side frame 121.

The upper-side frame 121 is provided with the pair of attachment brackets 39. The upper-side frame 121 is included in the concept of the main frame of the present invention. The upper-side frame 121 has a shape similar to the front-side frame 21 (see FIG. 2) of the first embodiment. Note that the upper-side frame 121 is not provided with the turn support attachment section 27 (see FIG. 6). A dimension $W_{UF}$ of the upper-side frame 121 in the left-right direction is set similarly to the dimension $W_{FF}$ of the front-side frame 21 of the first embodiment in the left-right direction. A dimension $L_{UF}$ of the upper-side frame 121 in the front-rear direction is set similarly to the dimension $L_{FF}$ of the front-side frame 21 of the first embodiment in the front-rear direction.

A dimension $W_{LF}$ of the lower-side frame 123 in the left-right direction is set similarly to the dimension $W_{RF}$ of the rear-side frame 22 of the first embodiment in the left-right direction. The dimension of the lower-side frame 123 in the front-rear direction is larger than the dimension of the rear-side frame 22 of the first embodiment in the front-rear direction. The lower-side frame 123 is arranged such that the front section thereof overlaps with the lower side of the upper-side frame 121, and is joined to the upper-side frame 121 in that state. The upper-side frame 121 and the lower-side frame 123 are arranged in a T-shape when seen from above, in a state of being joined to each other. In parts corresponding to four corners of an area where the upper-side frame 121 and the lower-side frame 123 overlap, the upper-side frame 121 is provided with the joint bracket 31*a*, and the lower-side frame 123 is provided with the joint bracket 31*b*. By the corresponding brackets 31*a* and 3 lb being joined with a pin, the upper-side frame 121 and the lower-side frame 123 are joined. The configuration of the respective brackets 31*a* and 3 lb is similar to the configuration of the brackets 31*a* and 31*b* in the first embodiment. The turn support attachment section 27 is provided to the bottom surface of the lower-side frame 123. In detail, the turn support attachment section 27 is provided in an area of the bottom surface of the lower-side frame 123 that overlaps with the upper-side frame 121 when seen from above.

Modified Example 3 of First Embodiment

Figure 8:
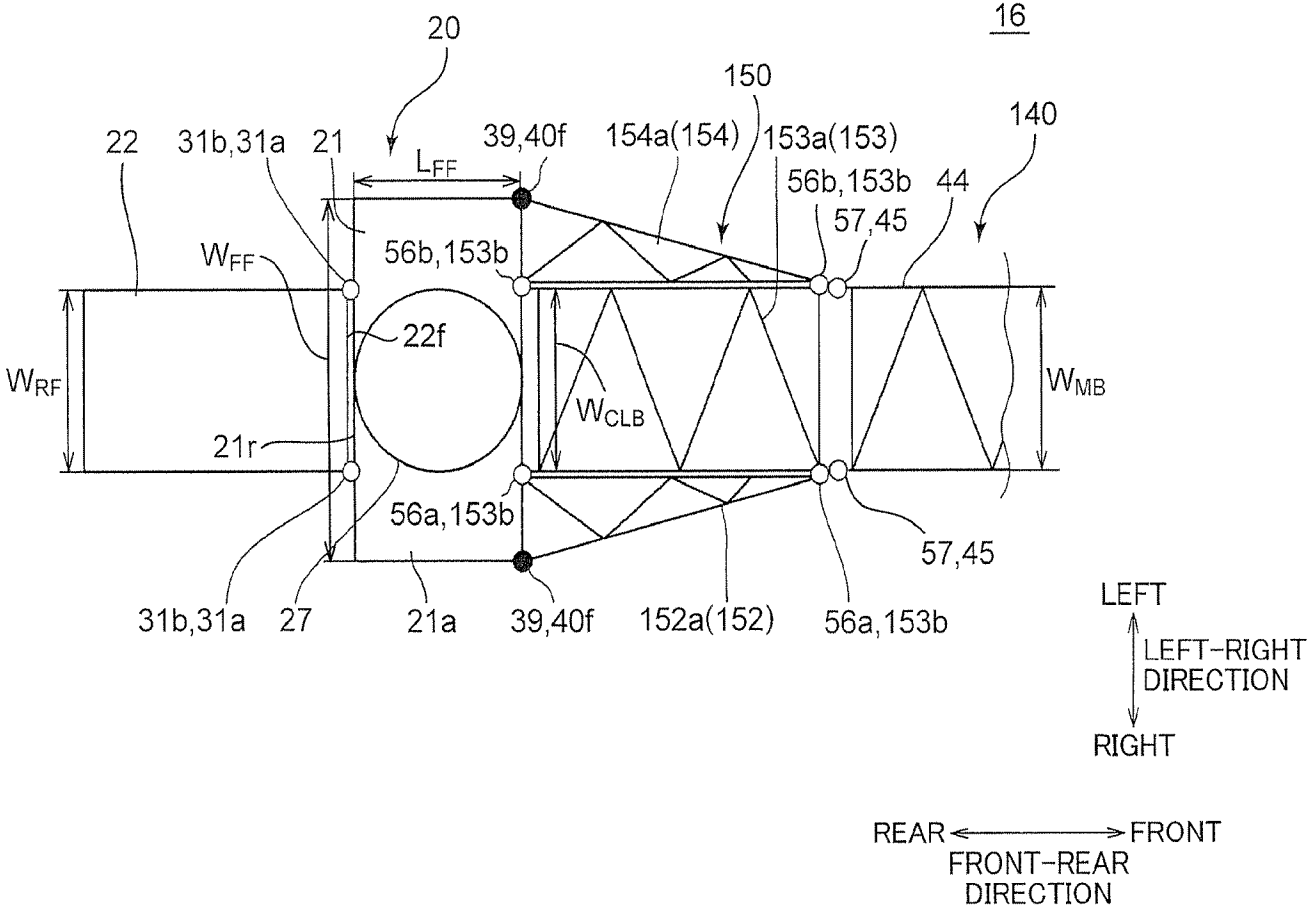
FIG. 8 is a view corresponding to FIG. 2 for modified example 3 of the first embodiment.

Referring to FIG. 8, the difference of a boom 140 of the upper turning body 16 according to modified example 3 of the first embodiment from the boom 40 according to the first embodiment above will be described.

Unlike the lower boom 50 of the boom 40 according to the first embodiment, a lower boom 150 of the boom 140 according to modified example 3 of the first embodiment allows for disassembly into three members in the left-right direction.

Specifically, the lower boom 150 includes a right-side divided boom 152, a middle divided boom 153, and a left-side divided boom 154. The lower boom 150 is dividable into the divided booms 152 to 154 in the left-right direction. The right-side divided boom 152, the middle divided boom 153, and the left-side divided boom 154 are included in the concept of the divided boom of the present invention. In the left-right direction, the middle divided boom 153 out of the divided booms 152, 153, and 154 is arranged in the middle. On the right side of the middle divided boom 153, the right-side divided boom 152 is arranged. On the left side of the middle divided boom 153, the left-side divided boom 154 is arranged. The right-side divided boom 152 and the middle divided boom 153 are separably joined to each other. The left-side divided boom 154 and the middle divided boom 153 are separably joined to each other.

The right-side divided boom 152 includes a right-side divided boom body 152*a* and the right-side boom joint bracket 56*a*. The right-side divided boom body 152*a* is formed in a lattice structure and takes up most of the right-side divided boom 152. The right-side boom joint bracket 56*a* is provided to the right-side divided boom body 152*a*. The left-side divided boom 154 includes a left-side divided boom body 154*a* and the left-side boom joint bracket 56*b*. The left-side divided boom body 154*a* is formed in a lattice structure and takes up most of the left-side divided boom 154. The left-side boom joint bracket 56*b* is provided to the left-side divided boom body 154*a*.

The right-side divided boom body 152*a* and the left-side divided boom body 154*a* are each formed in a triangle when seen from above in a state where the boom 140 is lowered, and arranged to be symmetrical to each other in the left-right direction. That is, the right side surface of the right-side divided boom body 152*a* is inclined gradually away from the left side surface of the right-side divided boom body 152*a* toward the base end section side of the lower boom 150, and the left side surface of the left-side divided boom body 154*a* is inclined gradually away from the right side surface of the left-side divided boom body 154*a* toward the base end section side of the lower boom 150. The right-side divided boom body 152*a* and the left-side divided boom body 154*a* may be formed in externally a trapezoidal shape when seen from above in a state where the boom 140 is lowered.

The right-side boom joint bracket 56*a* is provided to each of the front end section and rear end section of the left side surface of the right-side divided boom body 152*a*. The left-side boom joint bracket 56*b* is provided to each of the front end section and rear end section of the right side surface of the left-side divided boom body 154*a*.

The middle divided boom 153 includes a divided boom body 153*a* and a middle boom joint bracket 153*b*. The divided boom body 153*a* is formed in a lattice structure and takes up most of the middle divided boom 153. The middle divided boom body 153*a* is formed in externally a rectangular shape when seen from above in a state where the boom 140 is lowered. The middle boom joint bracket 153*b* is provided to each of the front end section and rear end section of the right side surface of the middle divided boom body 153*a* and to the front end section and rear end section of the left side surface of the middle divided boom body 153*a*.

The middle boom joint bracket 153*b* provided to the right side surface of the middle divided boom body 153*a* and the left-side boom joint bracket 56*a* provided to the left side surface of the right-side divided boom body 152*a* are separably joined to each other with a pin. Accordingly, the middle divided boom 153 and the right-side divided boom 152 are integrated. The middle boom joint bracket 153*b* provided to the left side surface of the middle divided boom body 153*a* and the left-side boom joint bracket 56*b* provided to the right side surface of the left-side divided boom body 154*a* are separably joined to each other with a pin. Accordingly, the middle divided boom 153 and the left-side divided boom 154 are integrated.

A dimension $W_{CLB}$ of the middle divided boom 153 in the left-right direction is equivalent to the dimension $W_{MB}$ of the intermediate boom 44 in the left-right direction and less than or equal to the transportation limit width. The dimension $W_{CLB}$ is preferably a dimension equivalent to the transportation limit width. Upon transportation of the crane, the middle divided boom 153 is, in a state where the left-right direction thereof matches the left-right direction of the transportation vehicle, loaded on the transportation vehicle. The dimensions of the right-side divided boom 152 and the left-side divided boom 154 in the left-right direction are also less than or equal to the transportation limit width.

Alternative Modified Examples of First Embodiment

Various modified examples of the first embodiment can be given, other than modified examples 1 to 3 described above.

For example, the turning frame may be unable to be disassembled into a plurality of members in the front-rear direction. That is, it may be such that the turning frame includes the front-side frame, but does not include the rear-side frame.

The turning frame may allow for disassembly into three or more members in the front-rear direction. For example, in addition to the turning frame allowing for disassembly into the front-side frame and the rear-side frame, at least one of the front-side frame and the rear-side frame may allow for disassembly into a plurality of members in the front-rear direction.

In the configuration in which the turning frame allows for disassembly into the plurality of divided frames in the front-rear direction, the divided frame provided with the attachment bracket may not be a divided frame arranged on the frontmost side out of the plurality of divided frames.

The turning frame may allow for disassembly into three or more members in the up-down direction. For example, at least one of the upper-side frame and the lower-side frame forming the turning frame may allow for disassembly into a plurality of members in the up-down direction.

In the configuration in which the turning frame allows for disassembly into the plurality of divided frames in the up-down direction, the divided frame provided with the attachment bracket may not be a divided frame arranged on the uppermost side out of the plurality of divided frames. For example, another divided frame may be further arranged on the upper-side frame provided with the attachment bracket.

The lower boom may allow for disassembly into four or more members in the left-right direction.

The lower boom may be unable to be disassembled into a plurality of members in the left-right direction.

Second Embodiment

Figure 9:
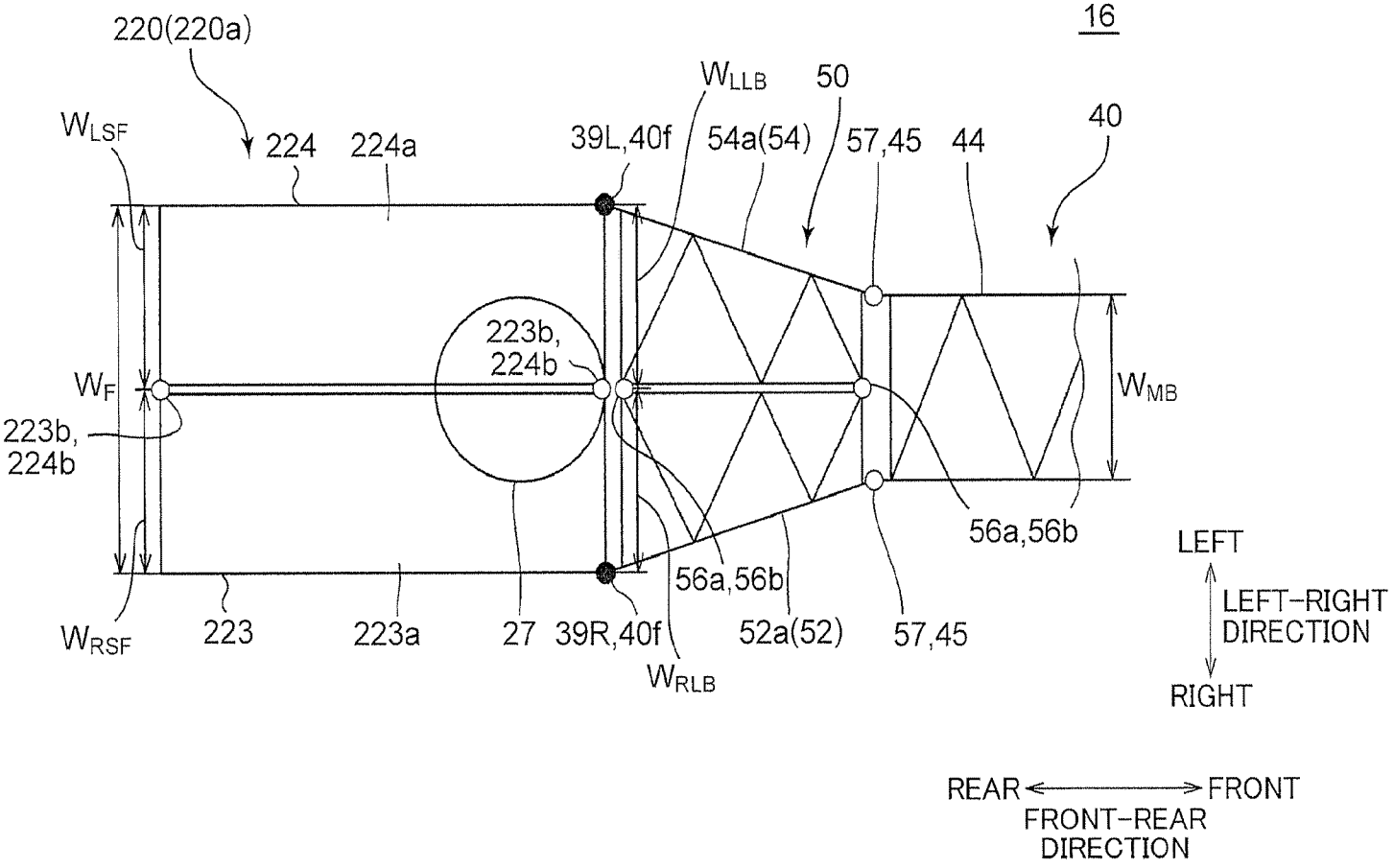
FIG. 9 is a view corresponding to FIG. 2 for a second embodiment.

Next, referring to FIG. 9, the upper turning body 16 according to the second embodiment of the present invention will be described.

The upper turning body 16 according to the second embodiment includes a turning frame 220 and a frame body 220*a* formed of a right-side frame 223 and a left-side frame 224 separably joined to each other in the left-right direction. The turning frame 220 allows for disassembly into the right-side frame 223 and the left-side frame 224 in the left-right direction.

The frame body 220*a* of the turning frame 220 is externally in a rectangular shape when seen from above. The right-side frame 223 forms a portion of the frame body 220*a* from the center up to the right-side end in the left-right direction. The left-side frame 224 forms a portion of the frame body 220*a* from the center up to the left-side end in the left-right direction. That is, the frame body 220*a* of the turning frame 220 allows for disassembly, with the center in the left-right direction thereof as a boundary, into the right-side frame 223 and the left-side frame 224. The right-side frame 223 and the left-side frame 224 are included in the concept of a divided frame of the present invention.

The right-side frame 223 includes a right-side frame body 223*a* and a right-side joint bracket 223*b*. The left-side frame 224 includes a right-side frame body 224*a* and a right-side joint bracket 224*b*. The right-side frame body 223*a* and the left-side frame body 224*a* are externally in a thin rectangular shape when seen from above. The external rectangular shape of the turning frame 220 is formed by the right-side frame body 223*a* and the left-side frame body 224*a*.

The right-side joint bracket 223*b* is provided to each of the front end section and rear end section of the left end section of the right-side frame body 223*a*. The left-side joint bracket 224*b* is provided to each of the front end section and rear end section of the right end section of the left-side frame body 223*a*. The right-side joint bracket 223*b* and the left-side joint bracket 224*b* each provided in corresponding positions are separably joined with a pin. The configuration of the right-side joint bracket 223*b* and the left-side joint bracket 224*b* joined thereto is similar to the configuration of the front-side joint bracket 31*a* and the rear-side joint bracket 31*b* joined thereto in the first embodiment.

Upon transportation of a crane, the right-side joint bracket 223*b* and the left-side joint bracket 224*b* are disjoined, and the turning frame 220 is disassembled into the right-side frame 223 and the left-side frame 224. The right-side frame 223 and the left-side frame 224 are, in a state where the left-right directions thereof match the left-right direction of a transportation vehicle, loaded on the transportation vehicle. A dimension $W_F$ of the turning frame 220 in the left-right direction is larger than a transportation limit width. A dimension $W_{RSF}$ of the right-side frame 223 in the left-right direction and a dimension $W_{LSF}$ of the left-side frame 224 in the left-right direction are both dimensions less than or equal to the transportation limit width. The dimension $W_{RSF}$ of the right-side frame 223 in the left-right direction and the dimension $W_{LSF}$ of the left-side frame 224 in the left-right direction are preferably dimensions equivalent to the transportation limit width. In the forward part of the bottom surface of both the right-side frame 223 and the left-side frame 224, the turn support attachment section 27 is attached. The turn support attachment section 27 is divided into two members in the left-right direction. The right-side member of the turn support attachment section 27 is provided to the bottom surface of the right-side frame 223. The left-side member of the turn support attachment section 27 is provided to the bottom surface of the left-side frame 224.

A pair of attachment brackets 39R and 39L are provided separately on the left and right at the front end section of the turning frame 220. Specifically, one attachment bracket 39R is provided to the right end section of the front end section of the turning frame 220, i.e., the right end section of the front end section of the right-side frame 223. The other attachment bracket 39L is provided to the left end section of the front end section of the turning frame 220, i.e., the right end section of the front end section of the left-side frame 224. With such an arrangement of the attachment brackets 39R and 39L, the interval between the attachment brackets 39R and 39L is larger than the transportation limit width. The configuration of the respective attachment brackets 39R and 39L and the base end section 40*f* of the boom 40 joined thereto is similar to the configuration of the respective attachment brackets 39 and the base end section 40*f* of the boom 40 joined thereto in the first embodiment. The structure of the boom 40 according to the second embodiment is similar to the structure of the boom 40 according to the first embodiment. Configurations other than the above of the upper turning body 16 and the crane according to the second embodiment are similar to configurations of the upper turning body 16 and the crane in the first embodiment.

In the second embodiment, the dimension $W_F$ of the turning frame 220 in the left-right direction is large, and the interval between the pair of attachment brackets 39R and 39L provided to the turning frame 220 is large. Therefore, the interval between the pair of attachment brackets 39R and 39L is large. Therefore, the dimension in the left-right direction of the lower boom 50 attached to the attachment brackets 39R and 39L can be increased. As a result, the stiffness in the left-right direction (lateral stiffness) near the base end section of the boom 40 can be enhanced. Therefore, deflection in the left-right direction (lateral deflection) of the boom 40 can be suppressed.

In the second embodiment, the turning frame 220 allows for disassembly into the right-side frame 223 and the left-side frame 224 in the left-right direction, and the dimension $W_{RSF}$ of the right-side frame 223 in the left-right direction and the dimension $W_{LSF}$ of the left-side frame 224 in the left-right direction are dimensions less than or equal to the transportation limit width. Therefore, upon transportation of the crane, the transportation width of the right-side frame 223 and the left-side frame 224 can be reduced to less than or equal to the transportation limit width of a public road, by loading, on the transportation vehicle, the right-side frame 223 and the left-side frame 224 in a state where the left-right directions thereof match the left-right direction of the transportation vehicle. Thus, in the second embodiment, transportation of the turning frame 20 of the upper turning body 16 can be carried out, while suppressing deflection of the boom 40 in the left-right direction.

Effects other than the above of the second embodiment are similar to the effects of the first embodiment.

Modified Example 1 of Second Embodiment

Figure 10:
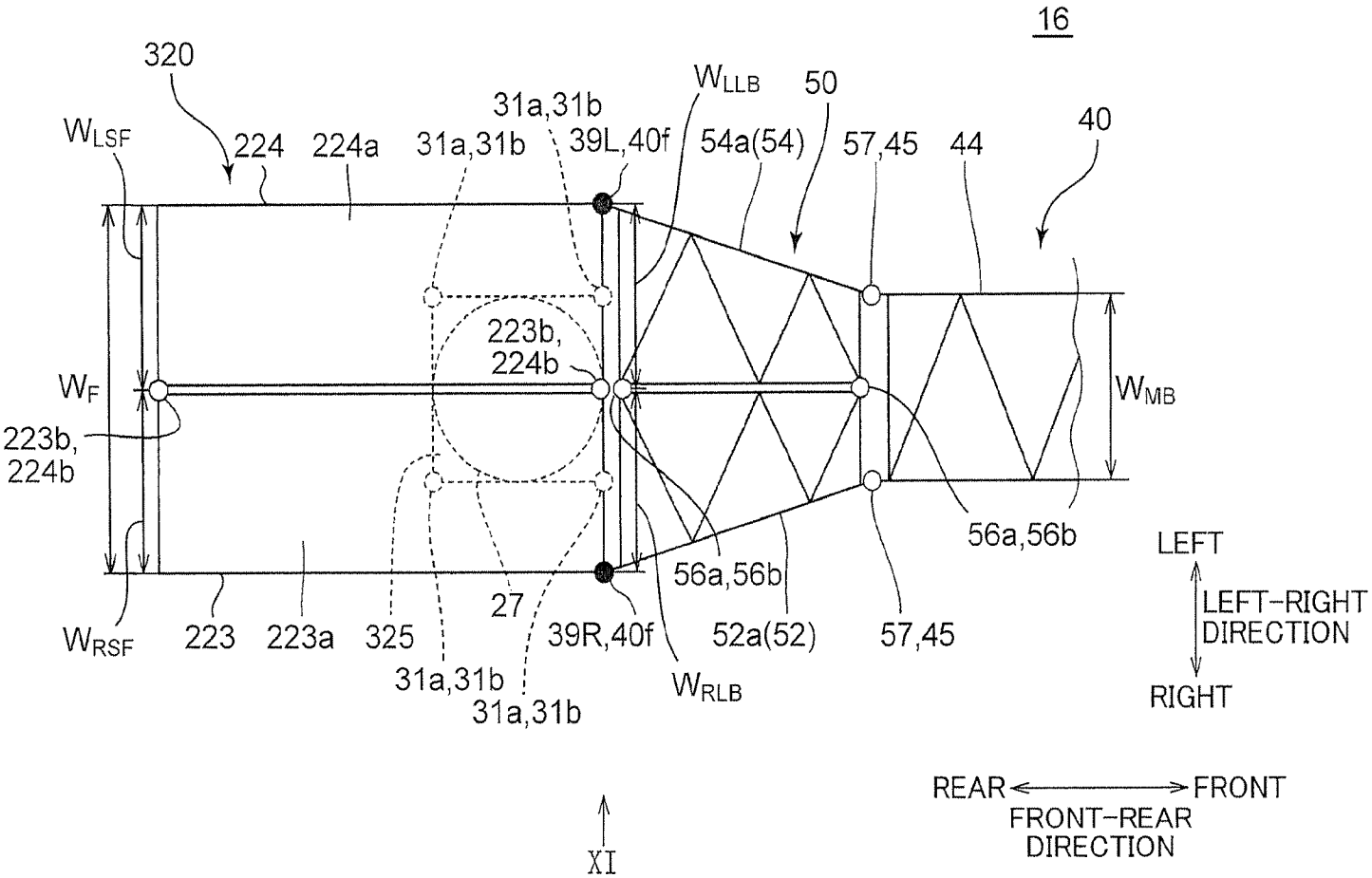
FIG. 10 is a view corresponding to FIG. 2 for modified example 1 of the second embodiment.
Figure 11:
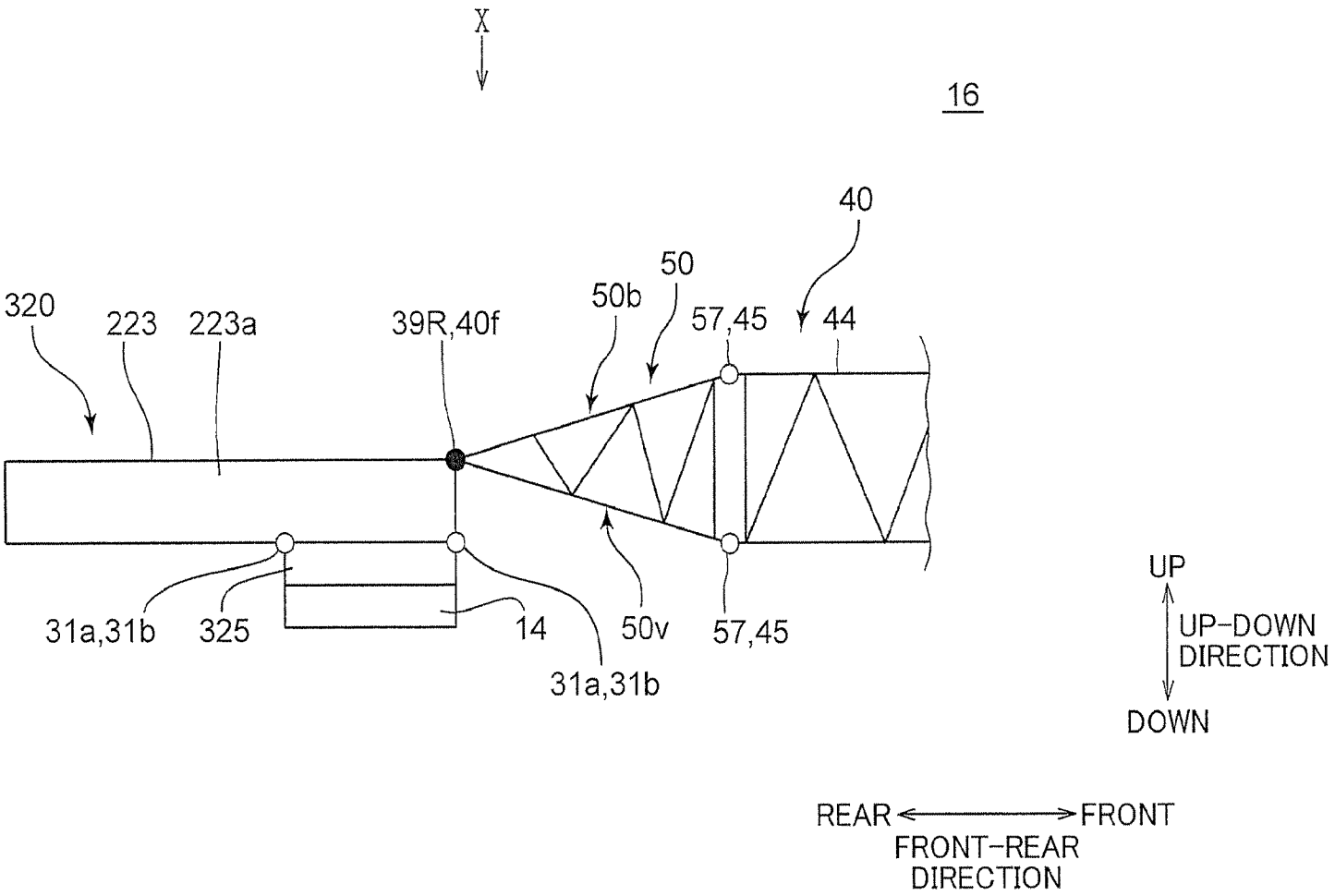
FIG. 11 is a view on arrow XI of FIG. 10.

Referring to FIG. 10 and FIG. 11, the difference of a turning frame 320 of the upper turning body 16 according to modified example 1 of the second embodiment from the second embodiment will be described. FIG. 11 is a view on arrow XI of FIG. 10. FIG. 10 is a view on arrow X of FIG. 11.

Unlike the turning frame 220 according to the second embodiment, the turning frame 320 according to modified example 1 of second embodiment allows for disassembly into a plurality of members in the up-down direction.

Specifically, as shown in FIG. 10, the turning frame 320 includes a lower-side frame 325 arranged below the right-side frame 223 and the left-side frame 224 and fixed to the bottom surface of the right-side frame 223 and the left-side frame 224.

The lower-side frame 325 is fixed to the right-side frame 223 and the left-side frame 224 at the front section in the middle section in the left-right direction. The lower-side frame 325 is separably joined to the right-side frame 223 and the left-side frame 224. Specifically, the joint brackets 31*b* are each provided to four corners at the upper end of the lower-side frame 325. The joint brackets 31*a* are each provided to respective parts corresponding to the four corners of the lower-side frame 325 in the right-side frame 223 and the left-side frame 224. By the corresponding joint brackets 31*a* and 31*b* being joined with a pin, the right-side frame 223, the left-side frame 224, and the lower-side frame 325 are joined.

The bottom surface of the lower-side frame 325 is provided with the turn support attachment section 27. The turn support attachment section 27 is provided only to the lower-side frame 325. The turn support attachment section 27 is not divided into a plurality of members as in the second embodiment. With this configuration, the turn support 14 (see FIG. 11) can be attached reliably to the turn support attachment section 27. The turn support 14 is transportable in a state of being attached to the turn support attachment section 27.

Modified Example 2 of Second Embodiment

Figure 12:
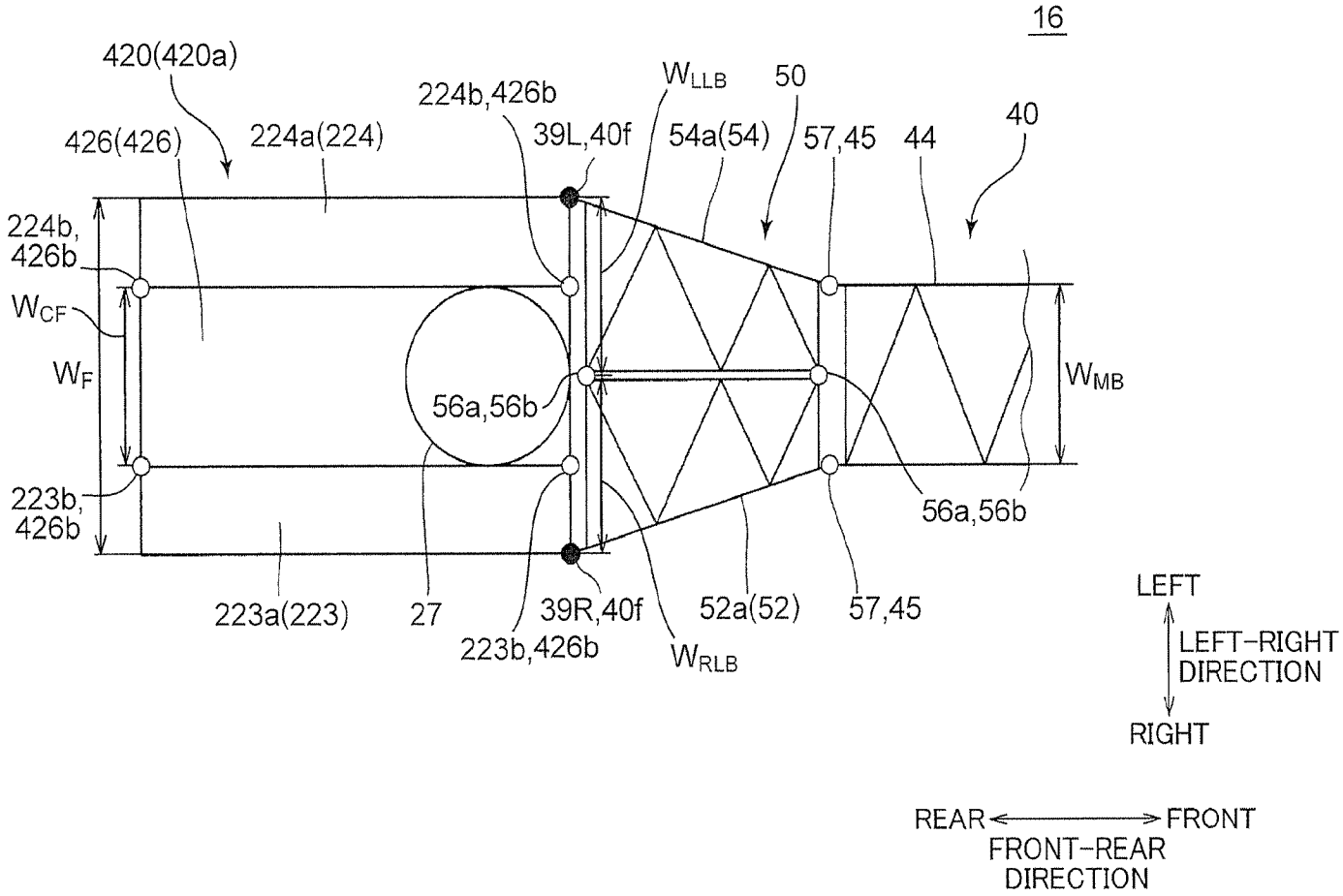
FIG. 12 is a view corresponding to FIG. 2 for modified example 2 of the second embodiment.

Referring to FIG. 12, the difference of a turning frame 420 according to modified example 2 of the second embodiment from the turning frame according to the second embodiment will be described.

The turning frame 420 according to modified example 2 of the second embodiment allows for disassembly into three members in the left-right direction.

Specifically, the turning frame 420 includes a middle frame 426, the right-side frame 223, and the left-side frame 224. The turning frame 420 allows for disassembly into the three frames in the left-right direction. The middle frame 426 is included in the concept of a middle divided frame of the present invention. The right-side frame 223 is included in the concept of a right-side divided frame of the present invention. The left-side frame 224 is included in the concept of a left-side divided frame of the present invention.

The middle frame 426 is arranged in the middle of the turning frame 420 in the left-right direction. The middle frame 426 includes a middle frame body 426*a* and a middle joint bracket 426*b*. The middle frame body 426*a* forms an approximately rectangular frame structure of the middle frame 426. The middle joint bracket 426*b* is provided to the middle frame body 426*a*.

The middle frame body 426 is formed in externally a rectangular shape when seen from above. The bottom surface of the middle frame body 426*a* is provided with the turn support attachment section 27. The turn support attachment section 27 is provided only to the middle frame body 426*a*. The turn support attachment section 27 is not divided and provided to the right-side frame 223 and the left-side frame 224. The middle frame 426 is mounted to turn freely on the lower traveling body 12 (see FIG. 1) with the turn support 14 therebetween. The middle joint bracket 426*b* is provided to each of the front end section and rear end section of the right side surface of the middle frame body 426 and to the front end section and rear end section of the left side surface of the middle frame body 426.

The right-side frame 223 is arranged on the right side of the middle frame 426 and separably joined to the right end section of the middle frame 426. The right-side frame 223 includes the right-side frame body 223*a* and the right-side joint bracket 223*b*. The right-side frame body 223*a* is externally in a thin rectangular shape when seen from above and forms a frame structure of the right-side frame 223. The right-side joint bracket 223*b* is provided to each of the front end section and rear end section of the left side surface of the right-side frame body 223*a*. Each right-side joint bracket 223*b* is separably joined to the corresponding middle joint bracket 426*b* with a pin. Accordingly, the right-side frame 223 and the middle frame 426 are integrated.

The left-side frame 224 is arranged on the left side of the middle frame 426 and separably joined to the left end section of the middle frame 426. The left-side frame 224 is formed to be vertically symmetrical to the right-side frame 223. The left-side frame 224 includes the left-side frame body 224*a* and the left-side joint bracket 224*b*. The left-side joint bracket 224*b* is provided to each of the front end section and rear end section of the right side surface of the left-side frame body 224*a*. Each left-side joint bracket 224*b* is separably joined to the corresponding middle joint bracket 426*b* with a pin. Accordingly, the left-side frame 224 and the middle frame 426 are integrated.

The middle frame 426, the right-side frame 223, and the left-side frame 224 form a frame body 420*a* of the turning frame 420. The dimension $W_F$ of the frame body 420*a* in the left-right direction, i.e., the dimension $W_F$ of the turning frame 420 in the left-right direction, is a dimension larger than the transportation limit width. The attachment bracket 39R on the right side is provided to the right end section of the front end section of the frame body 420*a*, i.e., the right end section of the front end section of the right-side frame 223. The attachment bracket 39L on the left side is provided to the left end section of the front end section of the frame body 420*a*, i.e., the left end section of the front end section of the left-side frame 224. The interval between the attachment brackets 39R and 39L is larger than the transportation limit width.

The dimension $W_{CF}$ of the middle frame 426 in the left-right direction is a dimension less than or equal to the transportation limit width and preferably a dimension equivalent or approximately equivalent to the transportation limit width. The dimension of the right-side frame 223 in the left-right direction and the dimension of the left-side frame 224 in the left-right direction are dimensions less than or equal to the transportation limit width. Upon transportation of the crane, the turning frame 420 is disassembled into the middle frame 426, the right-side frame 223, and the left-side frame 224. Then, the middle frame 426, the right-side frame 223, and the left-side frame 224 are, in a state where the left-right directions thereof match the left-right direction of the transportation vehicle, loaded on the transportation vehicle.

In modified example 2 of the second embodiment, the turning frame 420 of which the dimension in the left-right direction is larger than the transportation limit width can be disassembled into the middle frame 426, the right-side frame 223, and the left-side frame 224 having dimensions in the left-right direction less than or equal to the transportation limit width. Therefore, the turning frame 420 can be transported through a public road with the transportation vehicle.

In modified example 2, the frame body 420*a* of the turning frame 420 can be configured of the middle frame 426 and the left-side frame 224 and right-side frame 223 arranged to the left and right thereof. Therefore, the balance in terms of structure and strength of the turning frame 420 in the left-right direction can be improved.

Alternative Modified Examples of Second Embodiment

Various modified examples of the second embodiment can be given, other than modified examples 1 and 2 described above.

For example, the turning frame may allow for disassembly into four or more members in the left-right direction. Specifically, in addition to the turning frame allowing for disassembly into the right-side frame and the left-side frame, a divided frame forming the turning frame may be separably joined on the right side with respect to the right-side frame or the left side with respect to the left-side frame.

The turning frame allowing for disassembly into a plurality of members in the left-right direction may further allow for disassembly into a plurality of members in the front-rear direction.

The configuration of the second embodiment may be combined with the configuration of the first embodiment. That is, at least one frame of the right-side frame and the left-side frame may be formed such that the dimension in the front-rear direction is smaller than the dimension in the left-right direction, and the frame may be, in a state where the front-rear direction thereof matches the left-right direction of the transportation vehicle, loaded on the transportation vehicle for transportation.

The embodiments and modified examples disclosed herein should be considered as exemplary and not limiting in all respects. The scope of the present invention is shown by not the embodiments described above but the claims, and includes all equivalents to the claims and changes within the scope.

In modified example 1 of the first embodiment, the configuration of the front-side stopper and the rear-side stopper for inhibiting relative turning of the rear-side frame with respect to the front-side frame has been shown. Regarding the stoppers, modified examples below can be given.

Figure 13A:
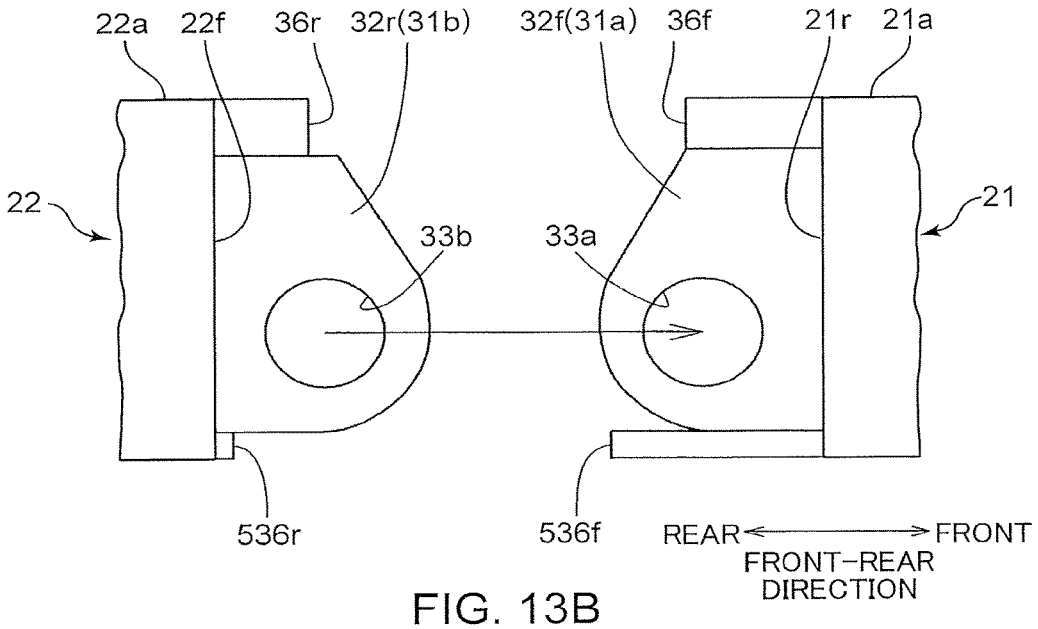
FIG. 13A is a view corresponding to FIG. 5A for an alternative modified example.
Figure 13B:
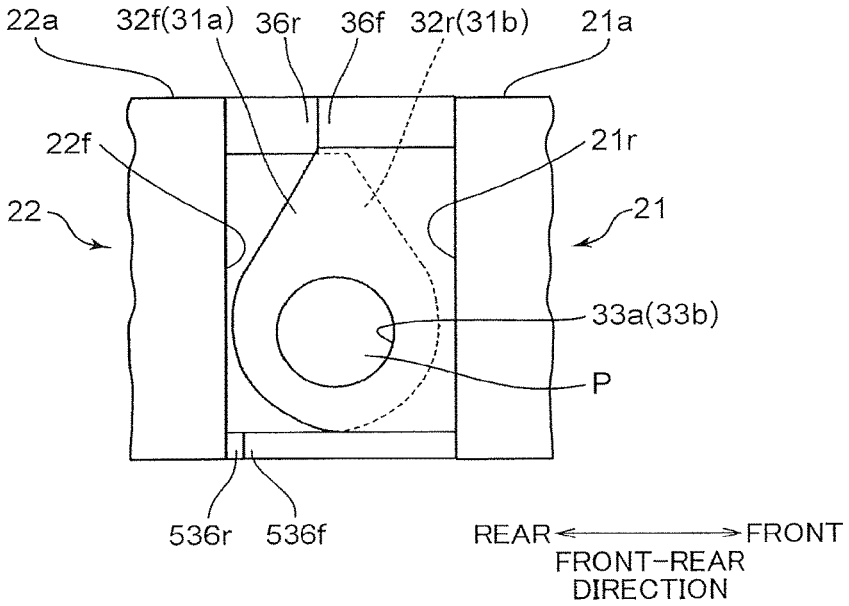
FIG. 13B is a view corresponding to FIG. 5B for the alternative modified example.

In FIG. 13A and FIG. 13B, the configuration of a front-side stopper 536*f* and a rear-side stopper 536*r* according to the modified example is shown. Referring to FIG. 13A and FIG. 13B, the front-side stopper 536*f* and the rear-side stopper 536*r* according to the modified example will be described.

As shown in FIG. 13A, the front-side stopper 536*f* according to the modified example is arranged below the front-side joint plate 32*f*, fixed to the rear surface 21*r* of the front-side frame 21, and fixed to the lower end of the front-side joint plate 32*f*. The rear-side stopper 536*r* according to the modified example is arranged below the rear-side joint plate 32*r*, fixed to the front surface 22*f* of the rear-side frame 22, and fixed to the lower end of the rear-side joint plate 32*r*.

The front-side stopper 536*f* and the rear-side stopper 536*r* inhibit the rear-side frame 22 from turning, in a direction of lowering the lower end section thereof, with respect to the front-side frame 21 about the pin P (see FIG. 13B) as the axis. Specifically, as shown in FIG. 13B, such turning of the rear-side frame 22 is inhibited by the rear-side stopper 536*r* being held in place by the front-side stopper 536*f*. In the modified example, the front-side stopper 36*f* above the front-side joint plate 32*f* is also provided in addition to the front-side stopper 536*f* below the front-side joint plate 32*f*, and the rear-side stopper 36*r* above the rear-side joint plate 32*r* is also provided in addition to the rear-side stopper 536*r* below the rear-side joint plate 32*r*. Therefore, turning of the rear-side frame 22 both upward and downward can be inhibited.

Figure 14A:
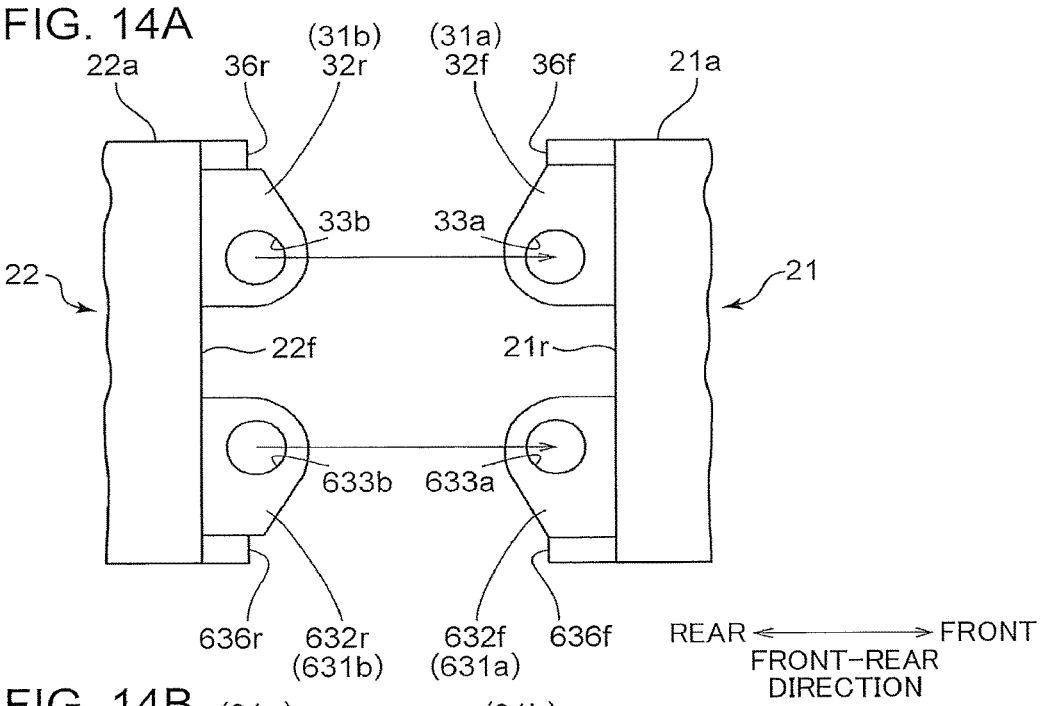
FIG. 14A is a view corresponding to FIG. 5A for yet another modified example.
Figure 14B:
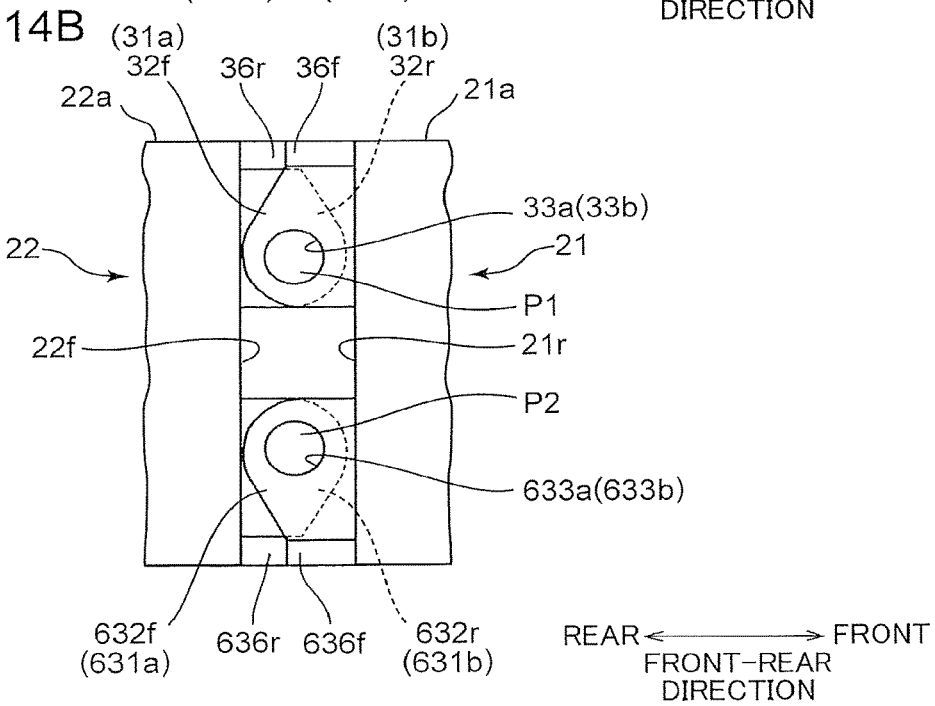
FIG. 14B is a view corresponding to FIG. 5B for the yet another modified example.

FIG. 14A and FIG. 14B show a front-side joint bracket, a front-side stopper, a rear-side joint bracket, and a rear-side stopper according to yet another modified example. Referring to FIG. 14A and FIG. 14B, the front-side and rear-side joint brackets and the front-side and rear-side stoppers according to the modified example will be described.

In the modified example, a front-side joint plate 632*f* of another front-side joint bracket 631*a*, in addition to the front-side joint plate 32*f* of the front-side joint bracket 31*a*, is fixed to the rear surface 21*r* of the front-side frame 21. A rear-side joint plate 632*r* of another rear-side joint bracket 631*b*, in addition to the rear-side joint plate 32*r* of the rear-side joint bracket 31*b*, is fixed to the front surface 22*f* of the rear-side frame 22. The front-side joint bracket 631*a* is arranged below the front-side joint bracket 31*a*. The rear-side joint bracket 631*b* is arranged below the rear-side joint bracket 31*b*. That is, the front-side joint plate 632*f* is arranged below the front-side joint plate 32*f*, and the rear-side joint plate 632*r* is arranged below the rear-side joint plate 32*r*. The front-side joint plate 632*f* has a structure horizontally symmetrical to the front-side joint plate 32*f*. The front-side joint plate 632*f* is formed with a hole 633*a* to which a pin P2 is inserted and fitted. The rear-side joint plate 632*r* has a structure horizontally symmetrical to the rear-side joint plate 32*r*. The rear-side joint plate 632*r* is formed with a hole 633*b* to which the pin P2 is inserted and fitted.

As shown in FIG. 14B, a pin P1 is inserted and fitted to the hole 33*a* of the front-side joint plate 32*f* and the hole 33*b* of the rear-side joint plate 32*r*, and the pin P2 is inserted and fitted to the hole 633*a* of the front-side joint plate 632*f* and the hole 633*b* of the rear-side joint plate 632*r*. Accordingly, the front-side frame 21 and the rear-side frame 22 are joined to each other in a state where turning is not possible.

The rear surface 21*r* of the front-side frame 21 is attached with a front-side stopper 636*f* fixed to the lower end of the front-side joint plate 632*f* on the lower side, in addition to the front-side stopper 36*f* fixed to the upper end of the front-side joint plate 32*f* on the upper side. The front surface 22*f* of the rear-side frame 22 is attached with a rear-side stopper 636*r* fixed to the lower end of the rear-side joint plate 632*r* on the lower side, in addition to the rear-side stopper 36*r* fixed to the upper end of the rear-side joint plate 32*r* on the upper side.

The first embodiment, the second embodiment, and the modified examples thereof described above may be combined in various ways.

For example, the boom 140 of modified example 3 of the first embodiment may be attached to the turning frame 220 (see FIG. 9) of the second embodiment.

Figure 15:
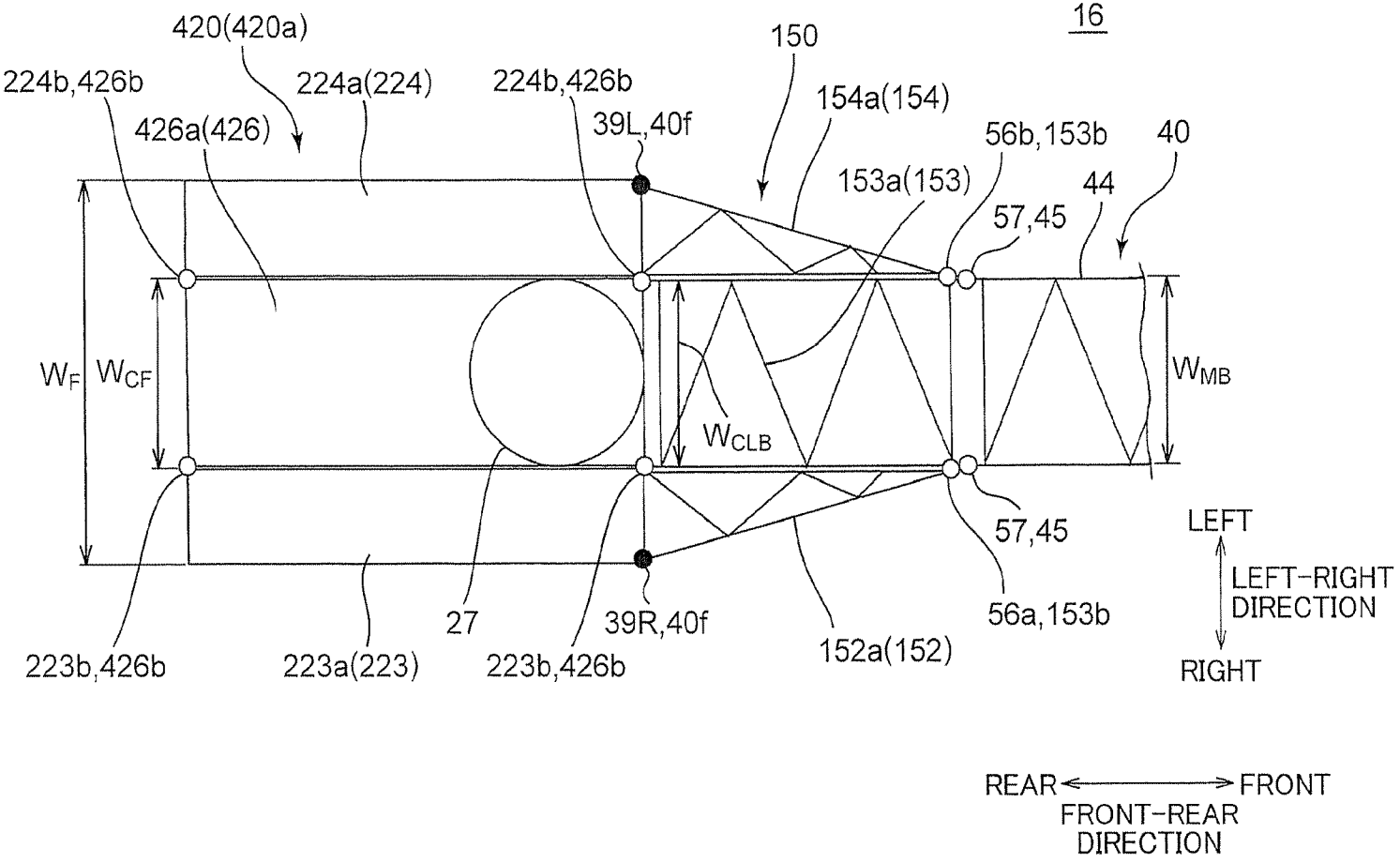
FIG. 15 is a view corresponding to FIG. 2 showing an upper turning body according to a modified example.

The boom 140 of modified example 3 of the first embodiment may be attached to the turning frame 420 (see FIG. 12) of modified example 2 of the second embodiment. The configuration of the upper turning body 16 according to the modified example is shown in FIG. 15. With the upper turning body 16 of the modified example, the stiffness of the lower boom 150 in the left-right direction is enhanced, and the stiffness of the entire turning frame 420 is also extremely enhanced. Therefore, the upper turning body 16 of the modified example is employed in extremely large cranes with a large hoisting ability.

In a normal-specification state of the upper turning body 16, the turning frame 420 does not necessarily need to include the right-side frame 223 and the left-side frame 224, and the lower boom 150 does not necessarily need to include the right-side divided boom 152 and the left-side divided boom 154. That is, in the upper turning body 16 of a normal specification, it may be such that the turning frame 420 includes only the middle frame 426, and the lower boom 150 includes only the middle divided boom 153. When deflection of the boom 40 in the left-right direction can be suppressed to less than or equal to an acceptable value upon performing hoisting work in the normal-specification state, it suffices to perform the hoisting work in the normal-specification state.

In the case where the normal specification poses a risk of deflection of the boom 40 in the left-right direction exceeding the acceptable value due to various factors such as a strong crosswind, a large length of the boom 40, or large hoisting load, it suffices to reinforce the boom 40 (the lower boom 150) through attachment of the right-side divided boom 152 and the left-side divided boom 154 to the middle divided boom 153 and to reinforce the turning frame 420 through attachment of the right-side frame 223 and the left-side frame 224 to the middle frame 426. That is, the right-side divided boom 152, the left-side divided boom 154, the right-side frame 223, and the left-side frame 224 may be reinforcement members as options of which the presence or absence of attachment is selected in accordance with various conditions.

Figure 16:
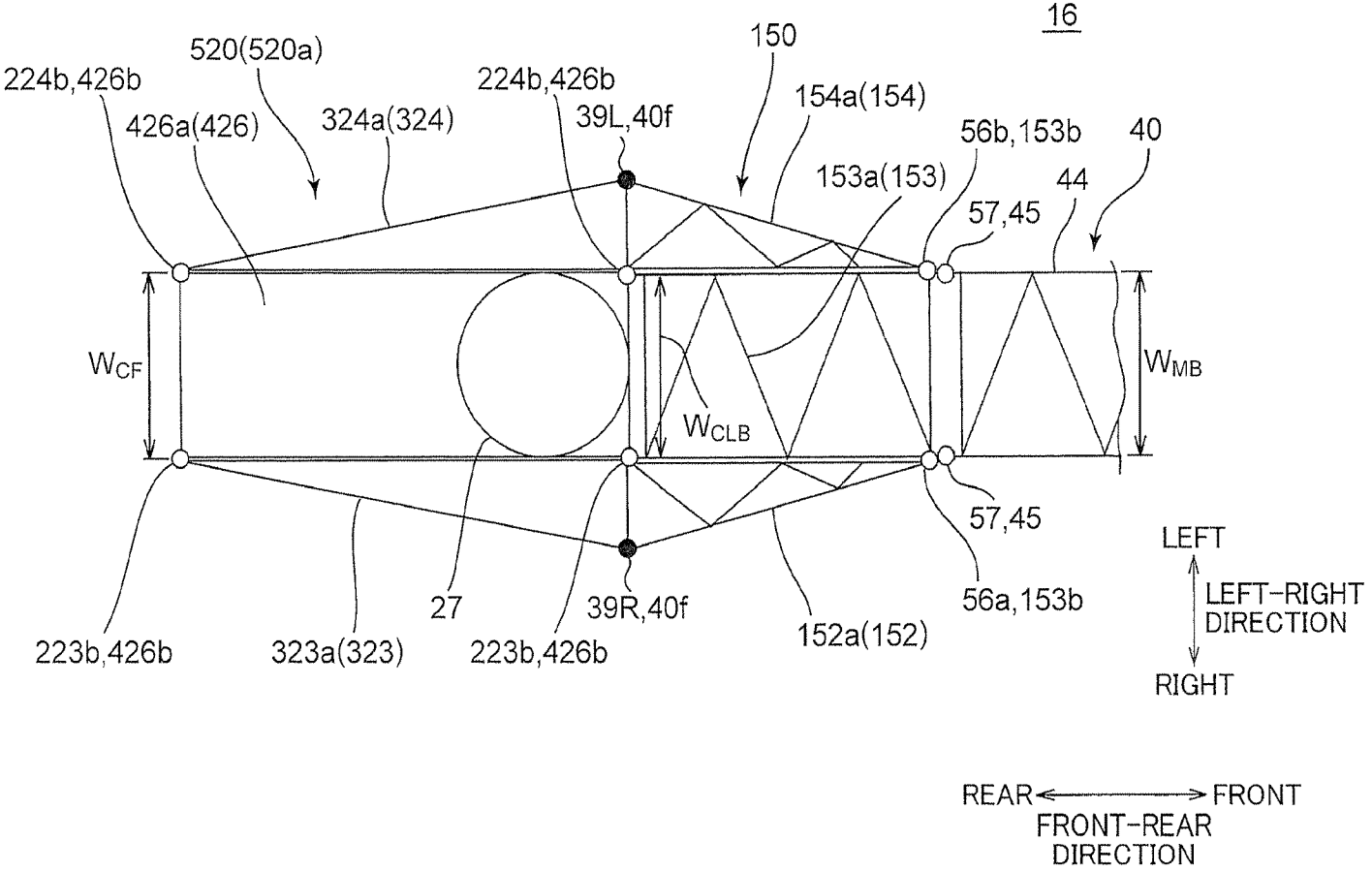
FIG. 16 is a view corresponding to FIG. 2 showing an upper turning body according to a further modified example of the modified example of FIG. 15.

A further modified example of the modified example shown in FIG. 15 is shown in FIG. 16. In the upper turning body 16 according to the modified example, the structure of a right-side frame 323 and a left-side frame 324 forming a frame body 520*a* of a turning frame 520 differs from the modified example shown in FIG. 15. Specifically, the right-side frame 323 and the left-side frame 324 are each externally in a triangular shape when seen from above and formed to be vertically symmetrical to each other. That is, the right side surface of the right-side frame 323 (a right-side frame body 323*a*) is inclined to gradually approach the left side surface of the right-side frame 323 (the right-side frame body 323*a*) toward the rear side, and the left side surface of the left-side frame 324 (a left-side frame body 324*a*) is inclined to gradually approach the right side surface of the left-side frame 324 (the left-side frame body 324*a*) toward the rear side. The right-side frame 323, the left-side frame 324, and the middle frame 426 form the frame body 520*a* of the turning frame 520. The dimension of the front end section of the frame body 520*a* in the left-right direction is a dimension larger than the transportation limit width.

With attachment of the right-side frame 323 and the left-side frame 324 with respect to the middle frame 426 in the modified example, the dimension of the rear section of the frame body 520*a* in the left-right direction can be reduced to suppress an increase in weight of the turning frame 520, while ensuring a large dimension of the front section of the frame body 520*a* in the left-right direction necessary for increasing the dimension of the base end section 40*f* of the boom 140 (the lower boom 150) in the left-right direction.

In the embodiments, the self-propelled lower traveling body has been shown as an example of the lower body of the present invention. However, the lower body of the present invention is not necessarily limited to such a carrier. For example, the lower body of the present invention may be that installed in a fixed manner at an installation part of a worksite or the like.

Figure 17:
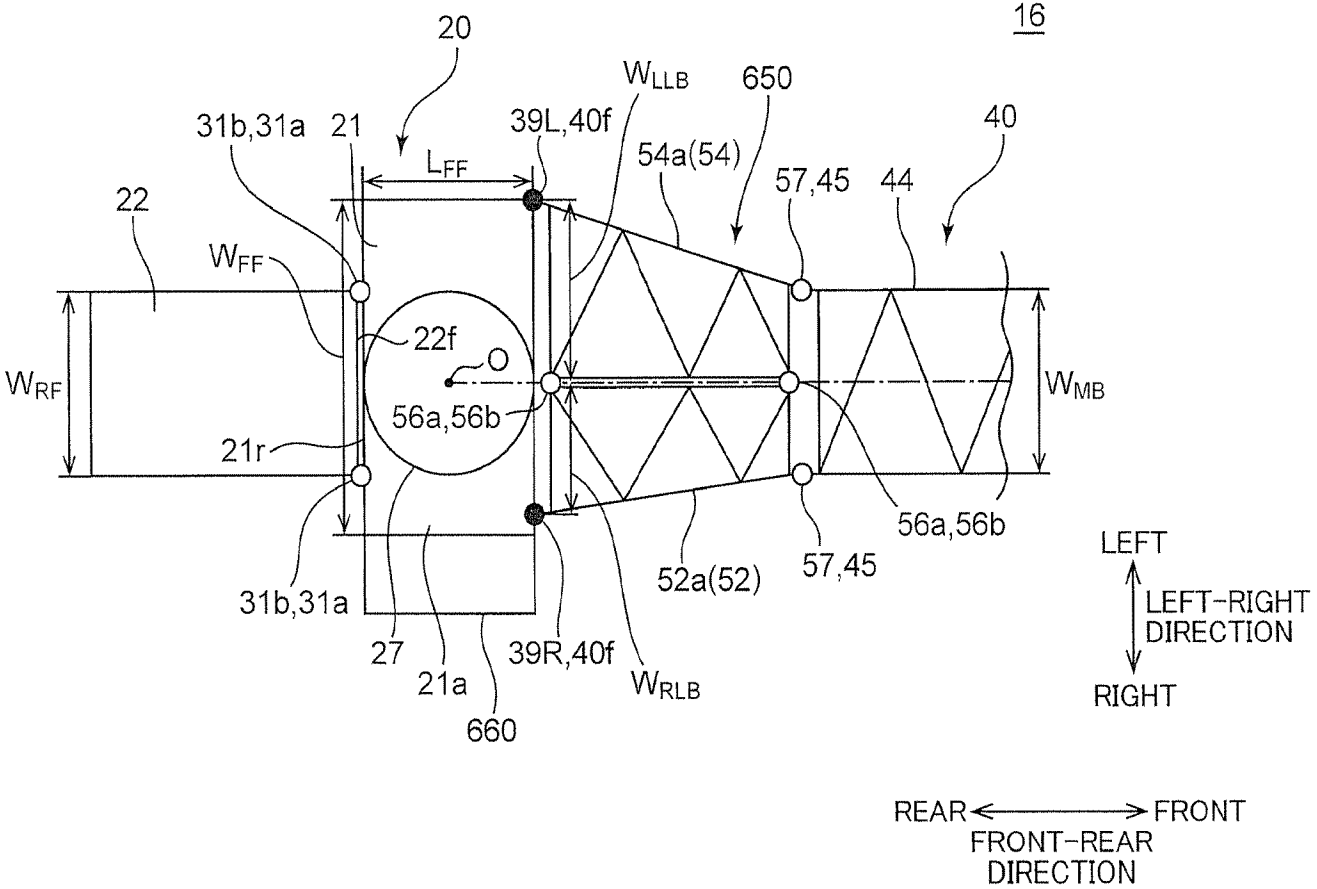
FIG. 17 is a view corresponding to FIG. 2 showing an upper turning body of a modified example including a vertically asymmetrical lower boom.
Figure 18:
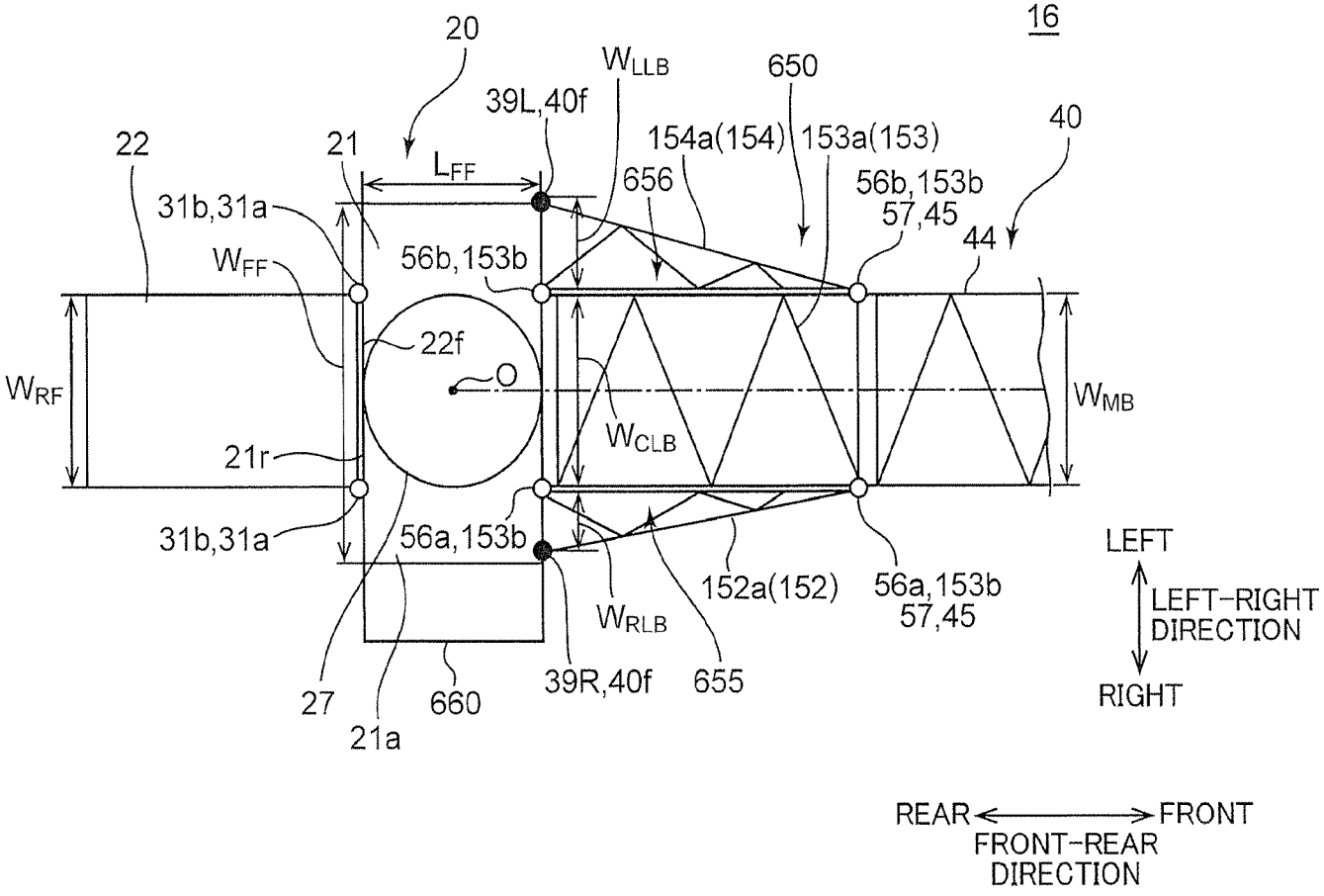
FIG. 18 is a view corresponding to FIG. 2 showing an upper turning body of another modified example including a vertically asymmetrical lower boom.
Figure 19:
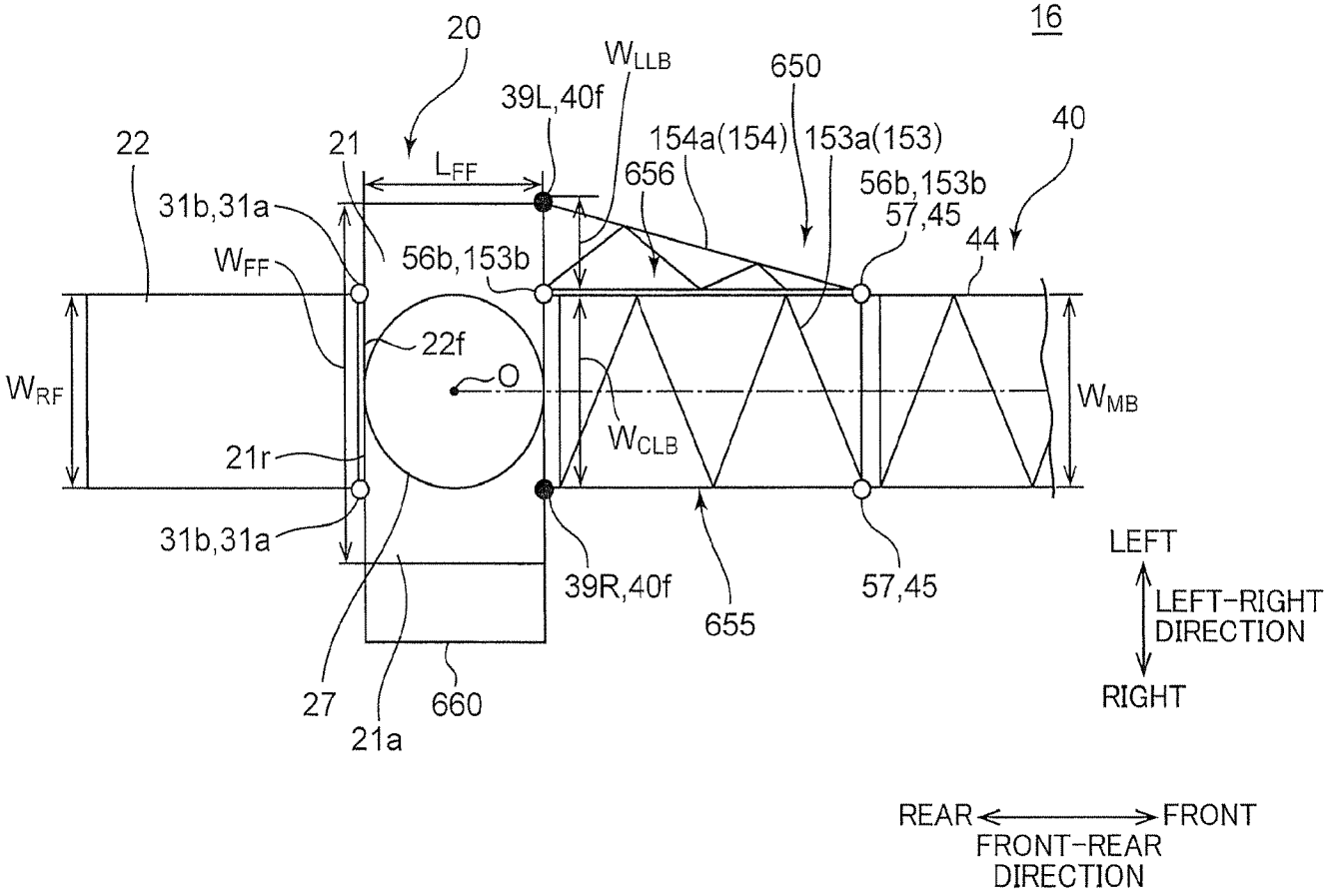
FIG. 19 is a view corresponding to FIG. 2 showing an upper turning body of yet another modified example including a vertically asymmetrical lower boom.
Figure 20:
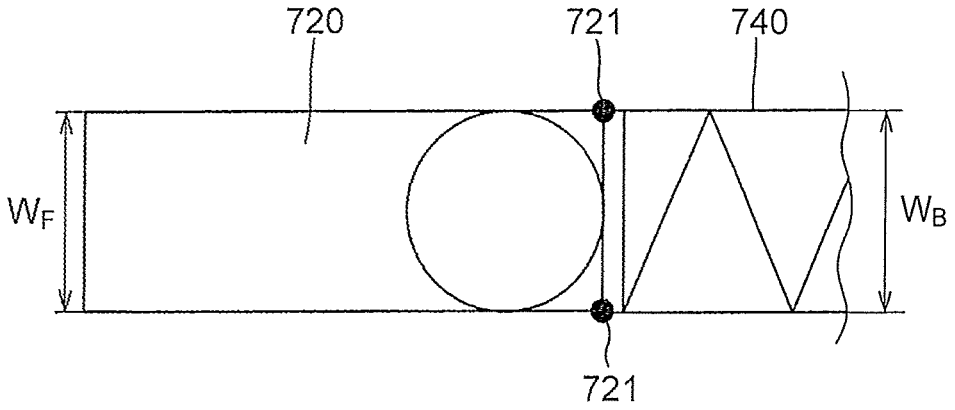
FIG. 20 PRIOR ART
FIG. 20 is a view corresponding to FIG. 2 showing a conventional upper turning body.

As in respective modified examples shown in FIG. 17 to FIG. 19, the boom 40 may include a lower boom 650 formed to be vertically asymmetrical. The configurations of the upper turning body 16 according to the respective modified examples of FIG. 17 to FIG. 19 will each be specifically described below.

The upper turning body 16 according to the modified example of FIG. 17 includes a cab 660 in which operation of the crane by an operator is performed. The cab 660 is arranged in a position offset toward one side (the right side in the modified example) from the turning center O of the turning frame 20 (the upper turning body 16) in the left-right direction and is attached to the turning frame 20. Specifically, the cab 660 is attached to the right end of the front-side frame 21. The turning center O matches the center of the turn support 14 (omitted in FIG. 17) and the center of the turn support attachment section 27.

The lower boom 650 includes the right-side divided boom 52 and the left-side divided boom 54, the right-side divided boom 52 being arranged on one side of the turning center O in the left-right direction, the one side being the cab 660 side, the left-side divided boom 54 being arranged on the other side of the turning center O in the left-right direction, the other side being a side opposite to the cab 660 side. In the modified example, the right-side divided boom 52 is included in the concept of a first segment according to the present invention, and the left-side divided boom 54 is included in the concept of a second segment according to the present invention. The right-side divided boom 52 has a width $W_{RLB}$ in the left-right direction that is smaller than a width $W_{LLB}$ of the left-side divided boom 54 in the left-right direction. Specifically, the width $W_{RLB}$ of the base end section in the left-right direction, the largest width in the left-right direction within the right-side divided boom 52, is smaller than the width $W_{LLB}$ of the base end section in the left-right direction, the largest width in the left-right direction within the left-side divided boom 54. Accordingly, the cab 660 side end of the right-side divided boom 54, i.e., the right end of the base end section of the right-side divided boom 54, is disposed in a position offset toward the turning center O from the cab 660 in the left-right direction.

The attachment bracket 39R on the cab 660 side (right side) provided to the front-side frame 21 is arranged on the turning center O side with respect to the cab 660 in the left-right direction. The base end section 40*f* of the lower boom 650 joined to the attachment bracket 39R on the cab 660 side is arranged on the turning center O side with respect to the cab 660 in the left-right direction to correspond to the attachment bracket 39R.

In the modified example of FIG. 17, the right-side divided boom 52 has the width $W_{RLB}$ in the left-right direction smaller than the width $W_{LLB}$ of the left-side divided boom 54 in the left-right direction, and the cab 660 side end of the right-side divided boom 52 is disposed in a position offset toward the turning center O from the cab 660. Therefore, the forward field of vision from the cab 660 is not blocked by the lower boom 650, and a favorable forward field of vision from the cab 660 can be ensured. The lower boom 650 does not interfere with the cab 660 when the boom 40 is raised, and therefore does not limit the angle by which the boom 40 is raised. Since the attachment bracket 39R on the cab 660 side is arranged on the turning center O side with respect to the cab 660, the installed position of the attachment bracket 39R does not interfere with the cab 660. Therefore, work of attaching the attachment bracket 39R with respect to the front-side frame 21 can be performed easily. With the attachment bracket 39R on the cab 660 side being arranged on the turning center O side with respect to the cab 660, the cab 660 does not become a hindrance upon attaching the base end section of the lower boom 650 with respect to the attachment bracket 39R. Therefore, work of attaching the boom 40 can be prevented from becoming complex.

The upper turning body 16 according to the modified example of FIG. 18 includes the cab 660 arranged in a similar manner to the case of the modified example of FIG. 17. In the modified example of FIG. 18, the lower boom 650 includes the right-side divided boom 152, the middle divided boom 153, and the left-side divided boom 154, and the right-side divided boom 152 has the width $W_{RLB}$ in the left-right direction smaller than the width $W_{LLB}$ of the left-side divided boom 154 in the left-right direction. With this configuration, the width in the left-right direction of a right-side segment 655 of the lower boom 650 arranged on the cab 660 side (right side) from the turning center O in the left-right direction is smaller than the width in the left-right direction of a left-side segment 656 of the lower boom 650 arranged on the opposite side (left side) to the cab 660 from the turning center O in the left-right direction. The right-side segment 655 is included in the concept of the first segment of the present invention. The left-side segment 656 is included in the concept of the second segment of the present invention. The cab 660 side end of the right-side segment 655, i.e., the right end of the base end section of the right-side divided boom 154, is disposed in a position offset toward the turning center O from the cab 660 in the left-right direction. The configuration of the upper turning body 16 other than the above according to the modified example of FIG. 18 is similar to the configuration of the upper turning body according to the modified example of FIG. 17. With the modified example of FIG. 18, an effect similar to the modified example of FIG. 17 can be obtained.

The upper turning body 16 according to the modified example of FIG. 19 includes the cab 660 arranged in a similar manner to the case of the modified example of FIG. 17. In the modified example of FIG. 19, the right-side segment 655 of the lower boom 650 is configured of only a portion of the middle divided boom 153 arranged on the cab 660 side from the turning center O. The left-side segment 656 of the lower boom 650 is configured of a portion of the middle divided boom 550 arranged on the opposite side to the cab 660 from the turning center O and the left-side divided boom 154. With this configuration, the width of the right-side segment 655 in the left-right direction is smaller than the width of the left-side segment 656 in the left-right direction. The cab 660 side (right side) end of the right-side segment 655, i.e., the cab 660 side (right side) end of the middle divided boom 550, is disposed in a position offset toward the turning center O from the cab 660 in the left-right direction. The configuration of the upper turning body 16 other than the above according to the modified example of FIG. 19 is similar to the configuration of the upper turning body according to the modified examples of FIG. 17 and FIG. 18. With the modified example of FIG. 19 as well, an effect similar to the modified example of FIG. 17 can be obtained.

The structure of the upper turning body 16 of the modified examples of FIG. 17 to FIG. 19 may be formed with the left and right reversed.

In the upper turning body 16 of the modified examples of FIG. 17 to FIG. 19, the configuration of the turning frame 20 is changeable. For example, in the upper turning body 16 of the modified examples of FIG. 17 to FIG. 19, the turning frame 120 shown in FIG. 6 and FIG. 7, the turning frame 220 shown in FIG. 9, the turning frame 320 shown in FIG. 10 and FIG. 11, the turning frame 420 shown in FIG. 12 and FIG. 15, or the turning frame 520 shown in FIG. 16 may be employed instead of the turning frame 20.

Summary of Embodiments

The embodiments are summarized as follows.

An upper turning body for a crane according to the embodiment is an upper turning body mounted on a lower body for a crane, including a turning frame mounted on the lower body to turn freely and a boom provided to the turning frame to be raised and lowered freely, wherein the turning frame includes a pair of attachment brackets to which a base end section of the boom is attached such that the boom is free to be raised and lowered, and a main frame to which the pair of attachment brackets are provided with an interval in a left-right direction of the upper turning body, and a dimension of the main frame in a front-rear direction of the upper turning body orthogonal to the left-right direction is smaller than a dimension of the main frame in the left-right direction.

In the upper turning body for a crane, the dimension of the main frame in the front-rear direction is smaller than the dimension in the left-right direction. Therefore, even in the case where the dimension of the boom in the left-right direction is increased in order to improve the stiffness of the boom in the left-right direction and suppress deflection of the boom in the left-right direction, and, in accordance therewith, the interval of the pair of attachment brackets to which the base end section of the boom is attached and the dimension of the main frame in the left-right direction provided with the pair of attachment brackets are increased, the transportation width of the turning frame can be reduced by loading, on a transportation vehicle, the turning frame in a state where the front-rear direction of the main frame matches the left-right direction of the transportation vehicle, upon transportation of the crane. That is, it is possible to prevent the transportation width of the turning frame from exceeding a transportation limit width of a public road. Thus, with the upper turning body for a crane, transportation of the turning frame of the upper turning body can be carried out upon transportation of the crane, even in the case where the dimension of the boom in the left-right direction is increased to suppress deflection of the boom in the left-right direction.

In the upper turning body for a crane, it is preferable that the turning frame further includes a subframe arranged on a rear side of the main frame and separably joined to the main frame, and a dimension of the subframe in the left-right direction is smaller than the dimension of the main frame in the left-right direction.

With this configuration, the subframe is connected to the rear side of the main frame when the crane is in the assembled state. Therefore, the dimension of the upper turning body in the front-rear direction can be increased, and the stability of the upper turning body can be improved. Addition of the subframe increases the installation space for various equipment and members mounted to the upper turning body, and therefore a layout of the equipment and members can be performed easily. Moreover, with this configuration, the subframe is separable from the main frame. Therefore, upon transportation of the crane, separating the subframe from the main frame and loading, on the transportation vehicle, the main frame in a state where the front-rear direction thereof matches the left-right direction of the transportation vehicle enables the main frame to be transported in a state where the transportation width is reduced. Since the dimension of the subframe in the left-right direction is smaller than the dimension of the main frame in the left-right direction, loading, on the transportation vehicle, the subframe in a state where the left-right direction thereof matches the left-right direction of the transportation vehicle can also reduce the transportation width of the subframe.

An upper turning body for a crane according to the present invention is an upper turning body mounted on a lower body for a crane, including a turning frame mounted on the lower body to turn freely and a boom provided to the turning frame to be raised and lowered freely, wherein the turning frame includes a pair of attachment brackets to which a base end section of the boom is attached such that the boom is free to be raised and lowered, and a frame body to which the pair of attachment brackets are provided with an interval in a left-right direction of the upper turning body, and the frame body is formed of a plurality of divided frames arranged side by side in the left-right direction of the upper turning body, adjacent divided frames of the plurality of divided frames being separably joined to each other.

In the upper turning body for a crane, the frame body is configured of the plurality of divided frames arranged side by side in the left-right direction, and the adjacent divided frames are separably joined to each other. Therefore, even in the case where the dimension of the boom in the left-right direction is increased in order to improve the stiffness of the boom in the left-right direction and suppress deflection of the boom in the left-right direction, and, in accordance therewith, the interval of the pair of attachment brackets to which the base end section of the boom is attached and the dimension in the left-right direction of the frame body provided with the pair of attachment brackets are increased, the transportation width of the turning frame can be reduced by the frame body being disassembled into respective divided frames and loaded on a transportation vehicle, upon transportation of the crane. That is, it is possible to prevent the transportation width of the turning frame from exceeding the transportation limit width of a public road. Thus, with the upper turning body for a crane, transportation of the turning frame of the upper turning body can be carried out upon transportation of the crane, even in the case where the dimension of the boom in the left-right direction is increased to suppress deflection of the boom in the left-right direction.

In this case, it is preferable that the plurality of divided frames include a middle divided frame attached on the lower body to turn freely, a right-side divided frame arranged on a right side of the middle divided frame and separably joined to a right end section of the middle divided frame, and a left-side divided frame arranged on a left side of the middle divided frame and separably joined to a left end section of the middle divided frame.

With this configuration, the frame body can be configured of the middle divided frame and the left-side divided frame and the right-side divided frame arranged to the left and right of the middle divided frame. Therefore, the balance in terms of structure and strength of the turning frame in the left-right direction can be improved.

Further, in this case, it is preferable that a left side surface of the left-side divided frame is inclined to approach a right side surface of the left-side divided frame toward a rear side, and a right side surface of the right-side divided frame is inclined to approach a left side surface of the right-side frame toward a rear side.

With this configuration, the dimension of the rear section of the frame body in the left-right direction irrelevant to an increase in dimension of the boom in the left-right direction can be reduced to suppress an increase in weight of the turning frame, while ensuring a large dimension of the front section of the frame body in the left-right direction necessary for increasing the dimension of the boom in the left-right direction in a state where the left-side divided frame and the right-side divided frame are joined to the middle divided frame.

In the upper turning body for a crane, it is preferable that the boom includes a lower boom attached to the pair of attachment brackets and forming a region of the boom, the region being a region which has a specific length from a base end section of the boom to a tip end section side of the boom, and a dimension of the lower boom in the left-right direction increases toward a base end section side of the lower boom.

With this configuration, the stiffness in the left-right direction near the base end section of the boom can be enhanced, and deflection of the boom in the left-right direction can be suppressed. With this configuration, the dimension of the lower boom in the left-right direction decreases toward the tip end section side of the lower boom. Therefore, an increase in weight of the lower boom can be suppressed, compared to a case where the dimension of the lower boom in the left-right direction is constant and large from the base end section up to the tip end section.

In this case, it is preferable that the lower boom is formed of a plurality of divided booms arranged side by side in the left-right direction, and adjacent divided booms of the plurality of divided booms are separably joined to each other.

With this configuration, the transportation width of the lower boom can be reduced by dividing the lower boom into the plurality of divided booms upon transportation of the crane, even in the case where the lower boom is configured such that the dimension of the lower boom in the left-right direction is increased toward the base end section side to improve the stiffness in the left-right direction near the base end section of the boom. It is possible to prevent the transportation width of the lower boom from exceeding the transportation limit width of a public road.

Further, in this case, it is preferable that the plurality of divided booms include a middle divided boom, a left-side divided boom arranged on a left side of the middle divided boom and separably joined to the middle divided boom, and a right-side divided boom arranged on a right side of the middle divided boom and separably joined to the middle divided boom.

With the configuration, the lower boom can be configured of the middle divided boom and the left-side divided boom and the right-side divided boom arranged to the left and right of the middle divided boom. Therefore, the balance in terms of structure and strength of the lower boom in the left-right direction can be improved.

Further, in this case, it is preferable that a left side surface of the left-side divided boom is inclined away from a right side surface of the left-side divided boom toward the base end section side of the lower boom, and a right side surface of the right-side divided boom is inclined away from a left side surface of the right-side divided boom toward the base end section side of the lower boom.

The configuration in which the boom includes the lower boom may be such that the upper turning body further includes a cab in which operation of the crane by an operator is performed, the cab is arranged in a position offset leftward or rightward from a turning center of the turning frame and attached to the turning frame, the lower boom includes a first segment and a second segment, the first segment being arranged on one side of the turning center in the left-right direction, the one side being a side on which the cab is disposed, the second segment being arranged on the other side of the turning center in the left-right direction, the other side being a side opposite to the one side, the first segment has a width in the left-right direction which is smaller than a width of the second segment in the left-right direction, and the first segment has a cab-side end which is one end in the left-right direction, and the cab-side end is disposed in a position offset toward the turning center from the cab in the left-right direction.

With this configuration, the first segment of the lower boom arranged on the cab side has a width in the left-right direction that is smaller than the width in the left-right direction of the second segment of the lower boom arranged on the opposite side to the cab, and the cab-side end of the first segment in the left-right direction is disposed in a position offset toward the turning center from the cab. Therefore, the forward field of vision from the cab is not blocked by the lower boom, and a favorable forward field of vision from the cab can be ensured. The lower boom does not interfere with the cab when the boom is raised, and therefore does not limit the angle by which the boom is raised. By the cab-side end of the first segment in the left-right direction being disposed in a position offset toward the turning center from the cab, the installed position of the attachment bracket on the cab side out of the pair of attachment brackets to which the lower boom is attached is arranged on the turning center side with respect to the cab. Therefore, the installed position of the attachment bracket does not interfere with the cab, and work of attaching the attachment bracket with respect to the turning frame can be performed easily. With the attachment bracket on the cab side being arranged on the turning center side with respect to the cab, the cab does not become a hindrance upon attaching the base end section of the lower boom with respect to the attachment bracket. Therefore, work of attaching the boom can be prevented from becoming complex.

As described above, with the embodiment, transportation of the frame of the upper turning body can be carried out upon transportation of the crane, while suppressing deflection of the boom in the left-right direction through an increase in dimension of the boom in the left-right direction.

The invention claimed is:

1. An upper turning body for a mobile crane including a lower traveling body, a turn support attached to the lower traveling body, and the upper turning body that is to be mounted to turn freely on the lower traveling body with the turn support therebetween, the upper turning body for a crane comprising:

a turning frame to be mounted on the lower travelling body to turn freely; and a boom provided to the turning frame to be raised and lowered freely, wherein the turning frame includes a pair of attachment brackets to which a base end section of the boom is attached such that the boom is free to be raised and lowered, and a main frame to which the pair of attachment brackets are provided with an interval in a left-right direction of the upper turning body, and a dimension of the main frame in a front-rear direction of the upper turning body orthogonal to the left-right direction is smaller than a dimension of the main frame in the left-right direction, wherein the turning frame further includes a subframe arranged on a rear side of the main frame and separably joined to the main frame, a dimension of the subframe in the left-right direction is smaller than the dimension of the main frame in the left-right direction, a dimension of the subframe in the front-rear direction is larger than the dimension of the subframe in the left-right direction, and the subframe is joined to a center part of the main frame in the left-right direction so as to be formed in a T-shape with the main frame when seen from above.

2. The upper turning body for a mobile crane according to claim 1, wherein the boom includes a lower boom attached to the pair of attachment brackets and forming a region of the boom, the region being a region which has a specific length from a base end section of the boom to a tip end section side of the boom, and a dimension of the lower boom in the left-right direction increases toward a base end section side of the lower boom.

3. The upper turning body for a mobile crane according to claim 2, wherein the lower boom is formed of a plurality of divided booms arranged side by side in the left-right direction, and adjacent divided booms of the plurality of divided booms are separably joined to each other.

4. The upper turning body for a crane according to claim 3, wherein the plurality of divided booms include a middle divided boom, a left-side divided boom arranged on a left side of the middle divided boom and separably joined to the middle divided boom, and a right-side divided boom arranged on a right side of the middle divided boom and separably joined to the middle divided boom.

5. The upper turning body for a crane according to claim 4, wherein a left side surface of the left-side divided boom is inclined away from a right side surface of the left-side divided boom toward the base end section side of the lower boom, and a right side surface of the right-side divided boom is inclined away from a left side surface of the right-side divided boom toward the base end section side of the lower boom.

6. The upper turning body for a crane according to claim 2, further comprising:

a cab in which operation of the crane by an operator is performed, wherein the cab is arranged in a position offset leftward or rightward from a turning center of the turning frame and attached to the turning frame, the lower boom includes a first segment and a second segment, the first segment being arranged on one side of the turning center in the left-right direction, the one side being a side on which the cab is disposed, the second segment being arranged on the other side of the turning center in the left-right direction, the other side being a side opposite to the one side, the first segment has a width in the left-right direction which is smaller than a width of the second segment in the left-right direction, and the first segment has a cab-side end which is one end in the left-right direction, and the cab-side end is disposed in a position offset toward the turning center from the cab in the left-right direction.

7. The upper turning body for a mobile crane according to claim 1, wherein the main frame is provided with a turn support attachment section to which the turn support is to be attached.

* * * * *